US007537387B2

(12) United States Patent
Spork et al.

(10) Patent No.: US 7,537,387 B2
(45) Date of Patent: May 26, 2009

(54) BAG WITH HANDLE INSERT AND RECLOSABLE BY FOLDING

(76) Inventors: Philip Bruce Spork, 20 Chartwell Street, Aspley, Queensland 4003 (AU); Edward John Charles Howard, 5 Bevan Street, Aspley, Queensland 4034 (AU)

( * ) Notice: Subject to any disclaimer, the term of this patent is extended or adjusted under 35 U.S.C. 154(b) by 372 days.

(21) Appl. No.: 10/473,344

(22) PCT Filed: Apr. 2, 2002

(86) PCT No.: PCT/AU02/00422

§ 371 (c)(1),
(2), (4) Date: Mar. 8, 2004

(87) PCT Pub. No.: WO02/079044

PCT Pub. Date: Oct. 10, 2002

(65) Prior Publication Data

US 2004/0136619 A1 Jul. 15, 2004

(30) Foreign Application Priority Data

Mar. 29, 2001 (AU) ..... PR4086

(51) Int. Cl.
*B65D 33/36* (2006.01)
*B65D 33/38* (2006.01)

(52) U.S. Cl. ..... 383/88; 383/17; 383/20; 383/36; 383/906

(58) Field of Classification Search ..... 383/88, 383/36, 17, 20, 906
See application file for complete search history.

(56) References Cited

U.S. PATENT DOCUMENTS

| | | | | | |
|---|---|---|---|---|---|
| 2,951,628 | A | * | 9/1960 | Grussen | 383/10 |
| 3,057,531 | A | | 10/1962 | Preen | |
| 3,642,189 | A | | 2/1972 | Widenback | |
| 3,924,797 | A | * | 12/1975 | Furbeck | 229/117.13 |
| 4,180,167 | A | * | 12/1979 | Leavitt et al. | 229/207 |
| 4,483,445 | A | | 11/1984 | Lipisto et al. | |
| 4,566,252 | A | | 1/1986 | Watanabe et al. | |
| 4,953,708 | A | | 9/1990 | Beer et al. | |
| 5,112,138 | A | * | 5/1992 | Peppiatt | 383/29 |
| 5,228,782 | A | | 7/1993 | Imer | |
| 5,593,229 | A | | 1/1997 | Warr | |
| 5,716,473 | A | * | 2/1998 | Gordon et al. | 156/200 |

(Continued)

FOREIGN PATENT DOCUMENTS

DE 32 32 321 A1 3/1984

(Continued)

*Primary Examiner*—Nathan J Newhouse
*Assistant Examiner*—Jack H Morgan, Jr.
(74) *Attorney, Agent, or Firm*—Young & Thompson

(57) ABSTRACT

A container (186) is provided with a tubular body (188) of a multi-plied material. The body (188) has an openable end (190) and a sealed end (192) with foldable and securable closure element that facilitate the non-destructive repeated opening and closing of the container (186). The closure element is integrally formed with the container (186) by the shape cutting and folded formation of the container end (190) during manufacture. The closure element is sectioned to include an openable section (196) which incorporates discharge element in the form of a pouring spout for discharge of container contents, and a closed section (198) which is adapted to incorporate carrying element (298) such as a handle.

11 Claims, 35 Drawing Sheets

U.S. PATENT DOCUMENTS

| | | | | | |
|---|---|---|---|---|---|
| 5,823,685 | A | * | 10/1998 | Garlichs | 383/211 |
| 5,934,550 | A | * | 8/1999 | Morris et al. | 229/121 |
| 5,938,337 | A | * | 8/1999 | Provan et al. | 383/5 |
| 6,048,100 | A | * | 4/2000 | Thrall et al. | 383/86 |
| 6,053,635 | A | | 4/2000 | Anderson et al. | |
| 6,120,184 | A | | 9/2000 | Laurence et al. | |
| 6,176,615 | B1 | | 1/2001 | Leimkuehler | |

FOREIGN PATENT DOCUMENTS

| | | |
|---|---|---|
| EP | 0 054 297 | 6/1982 |
| EP | 0 370 957 | 5/1990 |
| EP | 0 812 771 | 12/1997 |
| GB | 1141841 | 2/1969 |
| GB | 1419651 | 12/1975 |
| WO | 91/08148 | 6/1991 |

* cited by examiner

BAG WITH HANDLE INSERT AND RECLOSABLE BY FOLDING

FIELD OF THE INVENTION

THIS INVENTION relates to containers for packaging goods, and in particular, but not limited to, containers with closure means which provide non-destructive opening, and improved functional and ergonomic features. The invention further relates to methods for manufacturing such containers.

BACKGROUND OF THE INVENTION

Packaging is applied in various forms to the majority of products traded. The diversity of products requiring packaging ranges from chemicals to construction materials, agricultural supplies including feed and pesticide, and foods such as flour, sugar, peanuts, vegetable produce and even grocery items.

Advancements in packaging design have been focused on improving: the qualities and types of materials used in manufacture; methods of construction; container design; printing; and distribution systems. However, such advances have typically been biased to the needs immediately apparent to, or concerning, packaging manufacturers, and particularly those favouring improvements in the processes of filling and sealing containers.

It has, however, become apparent that end-user requirements have not been adequately addressed. Concerns relevant to end-users include: the cost of packaging; the inherent value and functionality of design including packaging strength, durability, re-closability and re-usability; the utility including ease of use and handling characteristics such as carry-ability and open-ability of packaging; and the conformance with industry and externally imposed regulations such as occupational safety and health regulatory requirements and standards.

The aforementioned problems arise primarily from deficiencies inherent with packaging design.

Closures for packaging are inadequate in many respects. Firstly, those in use make destruction of the container inevitable during opening. For example, where containers are sewn closed, the only options for opening include: i). undoing the string, however, this is too time consuming and will still leave a small section of string remaining as a potential contaminant; ii). cutting the string, which may result in pieces inadvertently entering the container; iii). using a tool, such as a knife, to cut an opening in the container, which complicates processing, creates a health and safety risk of injury to the user, requires that the tool be maintained (e.g. the knife sharpened), and still does not ensure against the contamination problem because of fragments of the container material such as torn fragments or slithers of paper entering the container. Other packaging closure techniques such as heat sealing or gluing suffer similar problems relying on destructive means such as tearing or cutting of the container to facilitate opening.

Contamination through opening procedures particularly affects the food industry because the health authorities such as the Australian and New Zealand Food Standards Council impose strict standards with respect to food purity. Furthermore, consumers do not tolerate well the inclusion of foreign matter in their food products and instances thereof will impinge on reputation and sales as customers become dissatisfied and complain.

A further problem inherent with state of the art closure means is the obvious environmental concern of unjustifiable wastage. Ideally, opening methods should be non-destructive so as to permit packaging re-closure.

Alternative packaging designs alleviating the above problems have been offered but are not feasible due, inter alia, to substantial increases in packaging costs. Such alternatives include the Rip-n-Zip® and Cut-n-Seal® patented closures.

The Rip-n-Zip® system is characterised by a first, single use closure comprising a tear-off strip which is removed prior to product use, and a second, multi-use closure comprising either a zip-fastener or plastic profile arrangement facilitating re-sealing and re-use of the container. A further drawback with this system is, however, the generation of a waste product, being the tear off strip, which must be disposed of following container opening.

The Cut-n-Seal® system similarly provides two closures, the interior-most closure being cut prior to product use, whereas the exterior-most closure, which comprises a plastic profile arrangement, similarly makes the container re-usable and re-sealable. However, a further disadvantage of this system is the necessary tool use.

Amcor Packaging (Australia) Pty Ltd's Patent Application No. PCT/AU98/00908 proposes an alternative solution, wherein closure means consisting of a flap extends from the container, the flap providing container closure when adhered to a removably attached tear-off strip, said strip being torn off the container for opening. However, inter alia, contamination is not all together eliminated and the strip component may present a disposal issue and does not provide for resealing of the bag.

OBJECT OF THE INVENTION

It is therefore an object of the invention to alleviate, at least to some extent, one or more of the aforementioned problems associated with the prior art.

In accordance with this objective the invention proposes a new container design incorporating foldable closure means providing non-destructive container opening and reclosure capacity. The closure of the invention improves the ease of container opening, without requiring tool use, whilst eliminating or at least lessening the problem of product contamination with container fragments. The improved container can include both functional and ergonomic benefits by making carrying and discharge means integral with the container design. Furthermore, manufacturing methods are taught by which the above outcomes can be achieved without adding undue expense, material or complexity to the production process. The invention supports use of existing container technology including container manufacturing and filling techniques as well as providing a point of attachment on the container for use of a mechanical lifting device therewith. The invention furthermore, conforms with industry imposed, including occupational health and safety standards.

OUTLINE OF THE INVENTION

In one aspect therefore the invention resides in a reclosable container including:

a body for holding contents;

said body having opposite ends, at least one of said ends being an openable end having integrally formed sectional closure means;

said sectional closure means including a closed section and an openable section in said at least one openable end;

there being folding means formed in said body to facilitate opening and closure of said openable end;

wherein said openable section is non-destructively openable by unfolding said body to form discharge means for emptying of said contents; and wherein said openable section is closable by folding retraction of said discharge means to effect container reclosure.

In preference, the container further includes securing means.

The securing means suitably secure the container and/or sections of the container closed.

The securing means preferably cooperate with the folding means to secure the container and/or sections of the container in one or more folded positions.

As would be appreciated by those skilled in the art, factors such as the necessary strength and reversibility of securing and the requirement for reusability of the securing means are likely to vary depending on, inter alia, end user requirements, the design and manufacture of the container, and whether the container or container section is to be secured closed or secured in one or more folding positions.

In preference, non-reusable securing means are used to secure the unopened container closed so as to provide tamper evidence of container opening and the extent thereof.

In preference, permanent securing means are used to secure the closed section of the sectional closure means closed.

In preference, non-permanent re-usable securing means are used to secure the container in one or more folded positions.

The securing means may comprise fastening means, attachment means, adhesive means or a combination of the foregoing. The preferred securing means comprise a selection of glues.

In preference, the container further includes carrying means to facilitate container carriage. The carrying means may be integrally formed with, or alternatively attachable to, the said container.

The preferred integral carrying means is formed in the openable container end and more preferably in said closed section thereof. In preference, the carrying means comprises a handle. The handle is suitably formed by punching out an appropriate profile or shape in the said container openable end so as to provide finger gripping means.

The alternative attachable carrying means may be fixedly or removably attached to the said container, preferably at said openable end and more preferably the closed section thereof.

The carrying means may be adapted for use independent of the said discharge means which suitably may be closed during container carriage to prevent inadvertent discharge of container contents.

The discharge means is suitably integral with the openable section of the openable container end and folds-out upon container opening to form an extended pouring spout. The openable section may be closed to prevent the inadvertent discharge of container contents through the discharge means. The size of the opening in said discharge means may be selectively adjustable, at least by the manufacturer, for regulation of the rate and other parameters of discharge.

In preference the container is further provided with support means to strengthen the container for carriage.

The preferred support means is in the form of a reinforcement to the carrying means or container section for carrying means attachment.

The reinforcement may be integral with, incorporated in or attached to the container and more preferably the closed section of the container openable end.

The material of manufacture of the reinforcement is suitably paper, cardboard, foil or plastic. The reinforcement preferably comprises a piece of said material or multiple pieces of material bonded together.

The preferred reinforcement comprises an insert for incorporation in the container during container manufacture. The insert is suitably incorporated within the closed section of the container openable end. The insert suitably extends the width of said closed section, being located preferably intermediate any side gussets, and may extend up to the full length of the container.

The insert is preferably secured, suitably by adhesive means such as glue, to the inside surface of the container. The glue may be applied to the container or more preferably the insert or parts of the surface thereof.

The insert shape may be cut or tapered and similarly the securing of the insert to the container adjusted on the side of the insert positioned proximal to the discharge means so as not to limit the rate of discharge of container contents through said openable section.

The container may be manufactured from any suitable material and particularly paper, cardboard, foil, plastic including woven plastic or composites thereof.

The container preferably comprises a bag of either multi-walled or single walled composition. The container may be gusseted or non-gusseted. The body of the container is suitably formed by longitudinal joining of the wall(s) to form a tube having a top end and a bottom end.

The top end of the container is suitably the openable end of the reusable container as it is shaped with extended and non-extended end sections suitably forming the openable and closed sections respectively of the reusable container following fold formation.

In preference, said folding means comprises one or more fold or crease lines formed in said container body. Suitably, said fold or crease lines designate the fold formations of the container for container opening and reclosure.

Preferably, at least one fold or crease line is formed in the openable section of the container. In preference, two obliquely orientated fold or crease lines are formed in said openable section. In one form, the said two oblique fold or crease lines are adapted to be folded concurrently to provide closure, and further, the angle of the oblique is most suitably around 45 degrees from the vertical. In an alternative form the said two oblique fold or crease lines are adapted to be folded in series. Alternatively, it is preferred that one horizontally orientated fold or crease line is formed in said openable section.

Preferably, at least one pair of fold or crease lines is formed in spaced apart opposing relationship along the length of the container. Suitably, said at least one pair of fold or crease lines designates the fold formation for container side edge and/or gusset formation.

Preferably, at least one fold or crease line is formed along the width of the container. Suitably said at least one fold or crease line designates the fold formation for folding the container into a substantially compacted configuration.

The container can be adjusted between varying, preferably reversible, degrees of closure.

In preference, at least partial opening of the container may be effected by undoing securing means and unfolding the container along fold lines.

In preference, closure of the container may be effected by folding the container along fold lines and suitably securing the container in folded and closed positions.

In a further aspect the invention provides a method of manufacturing multiple reclosable containers from a length of container material, wherein each of said multiple containers include:—a body for holding contents; said body having opposite ends, at least one of said ends being an openable end having integrally formed sectional closure means; said sectional closure means including a closed section and an openable section in said at least one openable end; there being folding means formed in said body to facilitate opening and closure of said openable end; wherein said openable section is non-destructively openable by unfolding said body to form discharge means for emptying of said contents; and wherein said openable section is closable by folding said discharge means to effect container reclosure, said method including the steps of:

cutting or perforating said material at spaced locations along said length with a shaped configuration extending across the width of said material; and separating respective said multiple reclosable containers at said spaced cut or perforated locations.

Preferably, said shape cutting or perforation defines the respective top and bottom ends of adjacently formed containers.

The shape of the cut or perforation may be, without limitation, straight, stepped, angled, curved or a combination thereof. The cut or perforation may be horizontally or obliquely orientated. Distinct cuts may be applied to the respective layers or walls forming a container body such that said walls or layers may be of different shape and dimension.

The container bottom end may be of any suitable configuration such as for example a flat, gusseted, open mouth or valved arrangement, the latter facilitating bottom end container filling. The container bottom end may be closed in accordance with methods known in the art irrespective of the shape of the perforation or cut applied thereto. Suitable closure means may comprise sewn, heat sealed, glued, folded, stapled, pinched or combination closures.

In an alternative aspect of the invention, the material may be cut or perforated at spaced locations along said length with alternating shaped and straight configurations extending across the width of said material. In preference, said shaped cutting or perforation defines the respective top ends of adjacently formed containers. The shaped configuration is suitably symmetrical. In preference, said straight cutting or perforation defines the respective bottom ends of adjacently formed containers.

The container may be filled either through the top or bottom end.

BRIEF DESCRIPTION OF THE DRAWINGS

In order that the invention may be more readily understood and put into practical effect reference will now be made to the accompanying drawings which illustrate preferred embodiments of the invention and wherein.

DETAILED DESCRIPTION OF THE DRAWINGS

Figure 1:
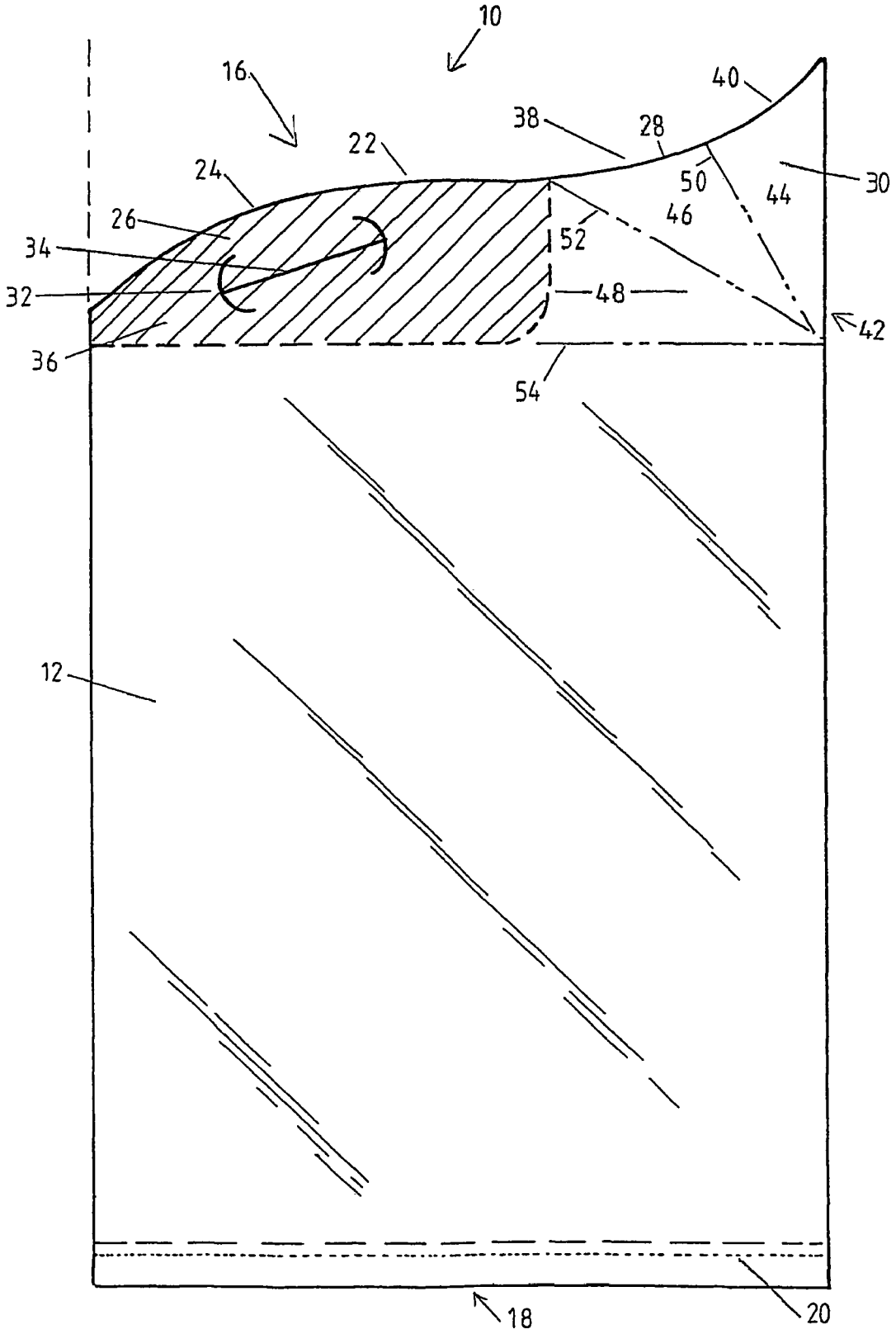
FIG. 1 is a front elevation view of a container according to a first embodiment of the present invention, shown with an open closure means.

Referring to the drawings wherein like reference numerals designate like parts throughout the several views and embodiments, and initially to FIG. 1, there is illustrated a container 10 according to a first preferred embodiment of the present invention.

The container is in the form of a multi-wall bag 10 comprising a substantially tubular body 12 joined longitudinally along seam 14 and including a partially opened top end 16 and a closed bottom end 18.

Any suitable closure can be used in relation to the container straight-cut bottom end, and in the embodiment illustrated the closure is effected by sewing together the container bottom edges 20.

The container top end 16 is designed to be openable and is configured by a shaped cut shown here as an obliquely orientated sinusoidal curve 22. The curve 22 comprises a lower substantially convex section 24 which defines an integral carrying means 26 of the container, and an upper substantially concave section 28 which defines an integral discharge means 30 of the container 10.

The carrying means 26 is shown here in the form of a reinforced handle 32 including a cut-out finger grip section 34, and a reinforcement in the form of an insert 36, whereas the discharge means 30 comprises a pouring spout having a mouth 38 and a spout section 40.

The container top end 16 includes closure means 42 formed as discrete sections 44, 46 and 48 foldable about crease lines 50, 52 and 54 to provide varying degrees of closure.

Figure 2:
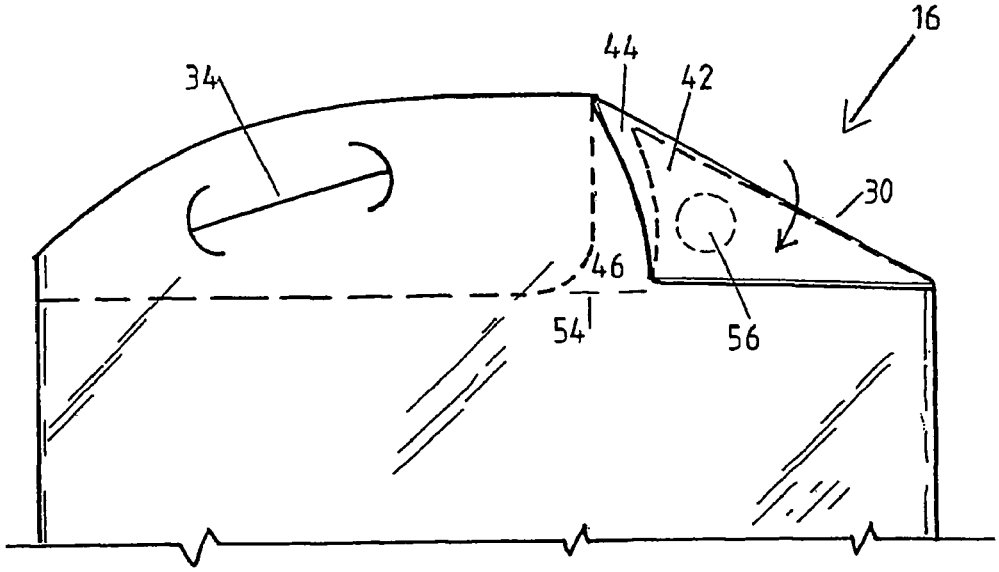
FIG. 2 illustrates the container of FIG. 1 with the closure means in a partially closed position with discharge means sealed and carrying means accessible.
Figure 3:
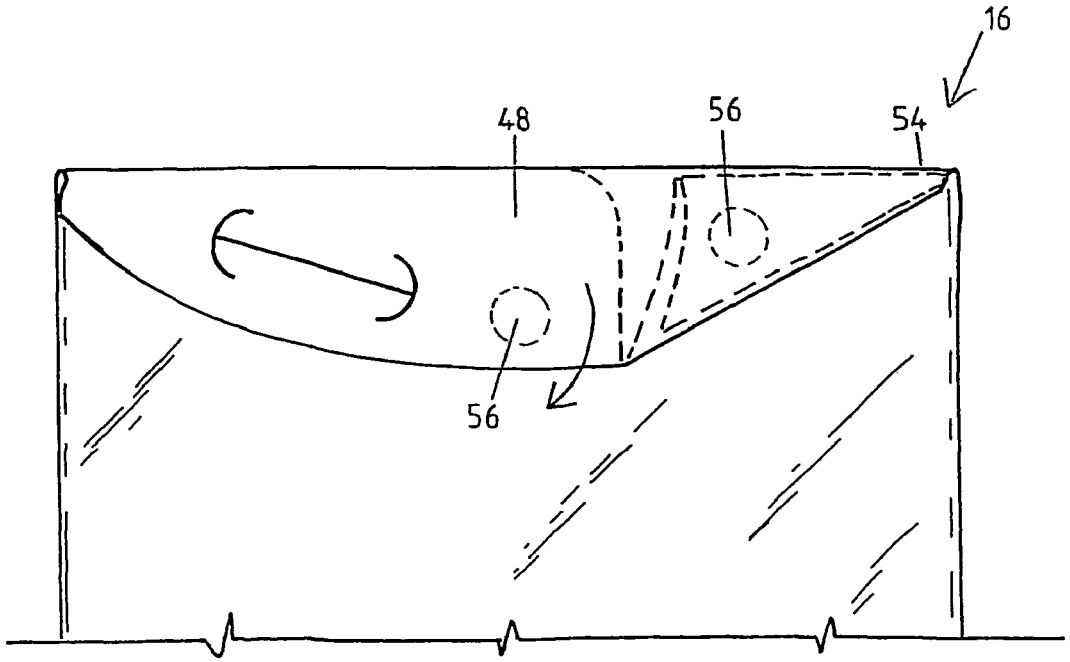
FIG. 3 illustrates the container of FIG. 1 with the closure means in a fully closed position.

As best illustrated in FIGS. 2 and 3, folding the closure means 42 about the first and second crease lines 50,52 effects closure and isolation of the container discharge means 30. Additional closure of the container 10 is optional and may be effected by folding the closure means 30 about the third crease line 54, providing a more effective closure whilst serving to enclose the handle 34 and form the top end section 16 of the container 10 into a substantially block shaped configuration for efficient container stacking. At each of the folds along fold lines 50, 52 and 54, the fold position is secured by spots of hot melt glue 56. The glue type chosen has preferred characteristics, the most important of which facilitate the non-destructive opening of the closure, and may enable re-securing thereof.

Container opening is the reverse of the above-disclosed closing procedure. The closure means of the invention facilitates gradational opening of the container as best illustrated in FIGS. 4 and 5.

Figure 4:
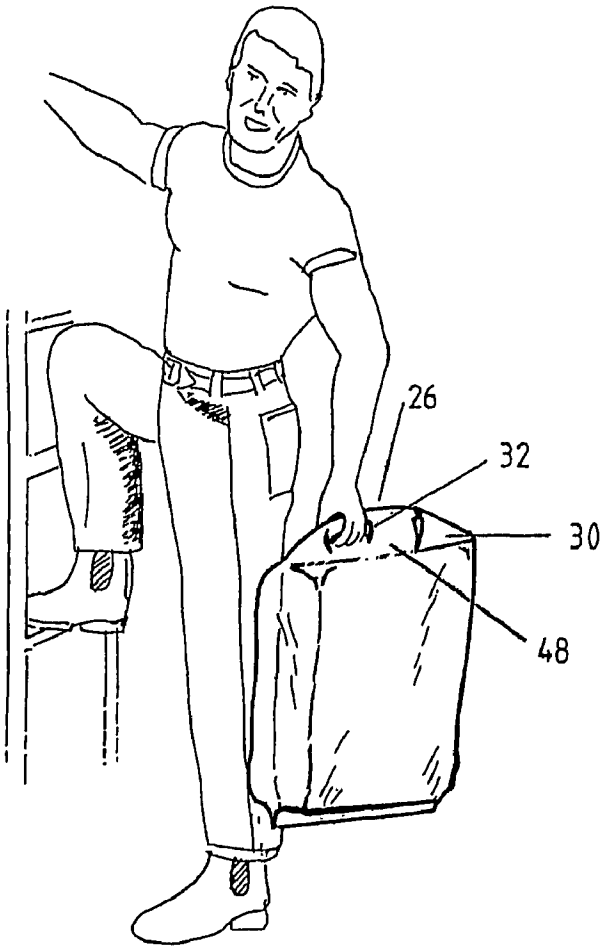
FIG. 4 illustrates a preferred use of the container carrying means in reference to the container embodied in FIG. 1.

With reference to FIG. 4, the container can be partially opened to make the carrying means 26 accessible for use, by unsealing a section 48 of the closure means and unfolding the said section 48 along the crease line 54. This facilitates carriage of the container 10 by said handle 32 whilst ensuring against spillage or contamination of the container contents by keeping the discharge means 30 closed.

Figure 5:
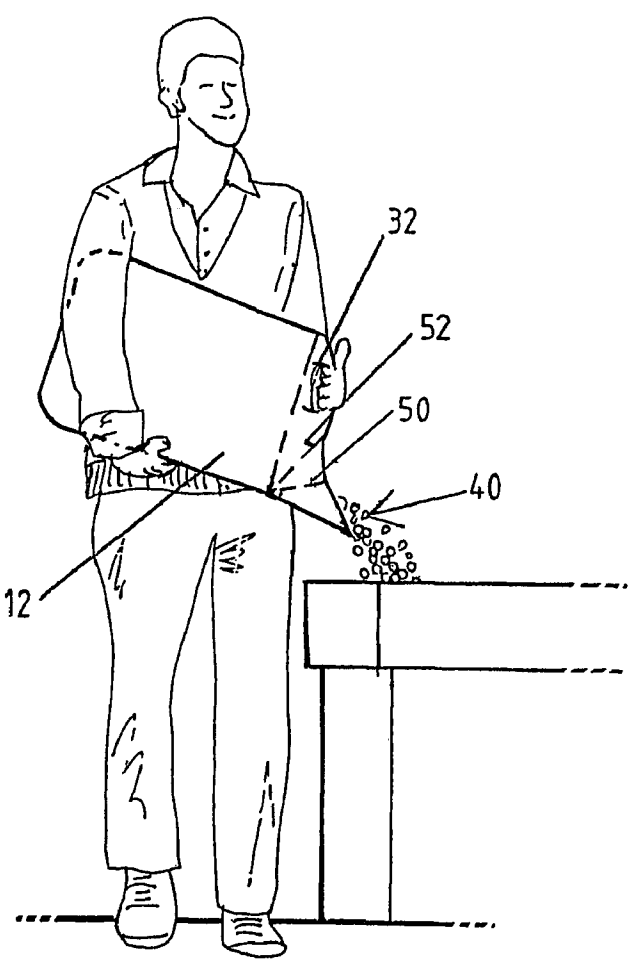
FIG. 5 illustrates a preferred use of the container discharge means in reference to the container embodied in FIG. 1.

FIG. 5 illustrates full opening of the container closure means 42 by unsealing and unfolding along the crease lines 50 and 52. The container contents can be discharged through the pouring spout 40 with the operator preferably holding the container via the handle 32 and supporting the container body 12 as shown.

The preferred manufacturing, filling, sealing and stacking procedures relevant to the container illustrated in the preceding drawings are shown in FIGS. 6 through 11.

Figure 6:
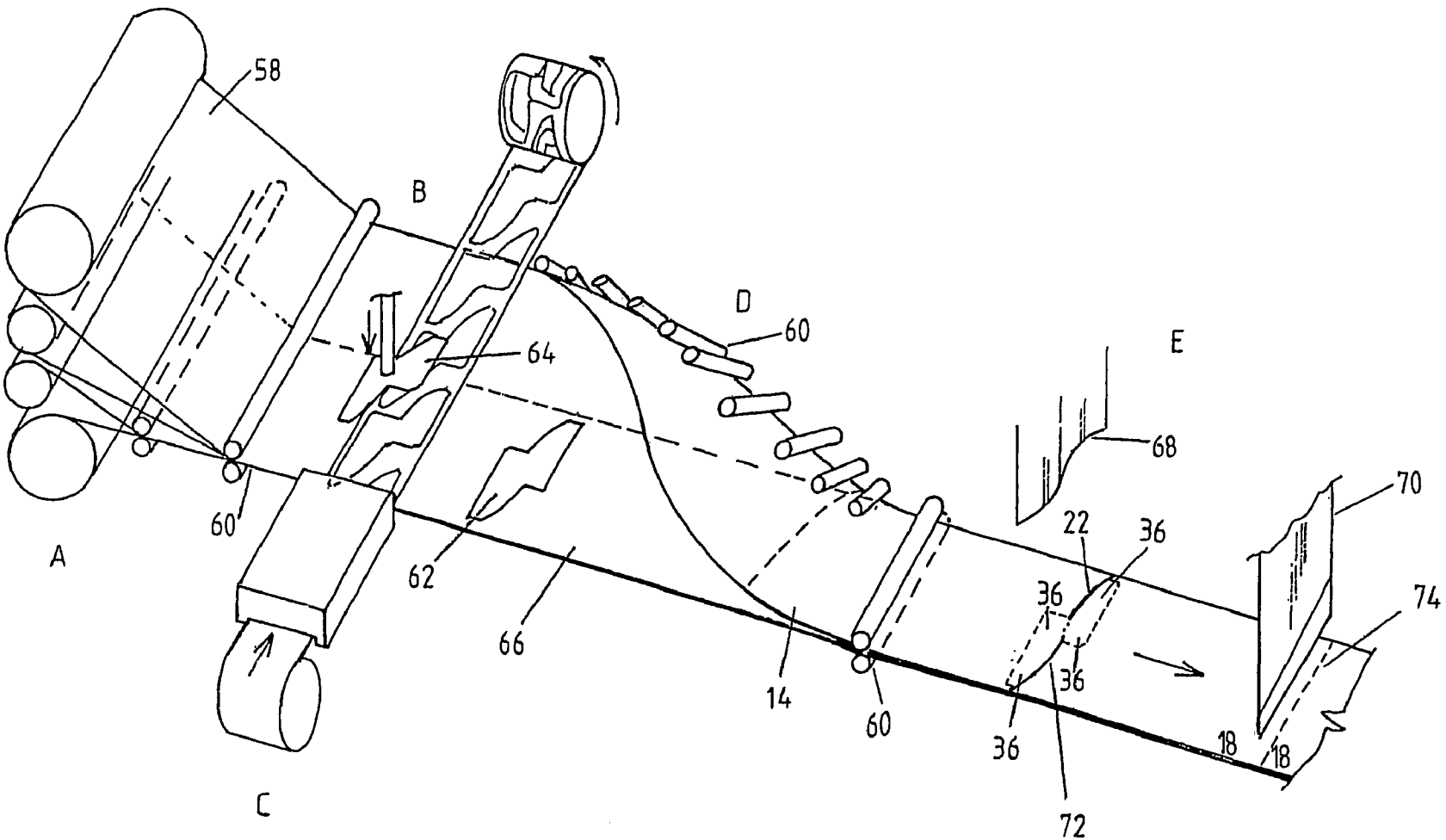
FIG. 6 outlines a preferred manufacturing process for the container embodied in FIG. 1.
Figure 7:
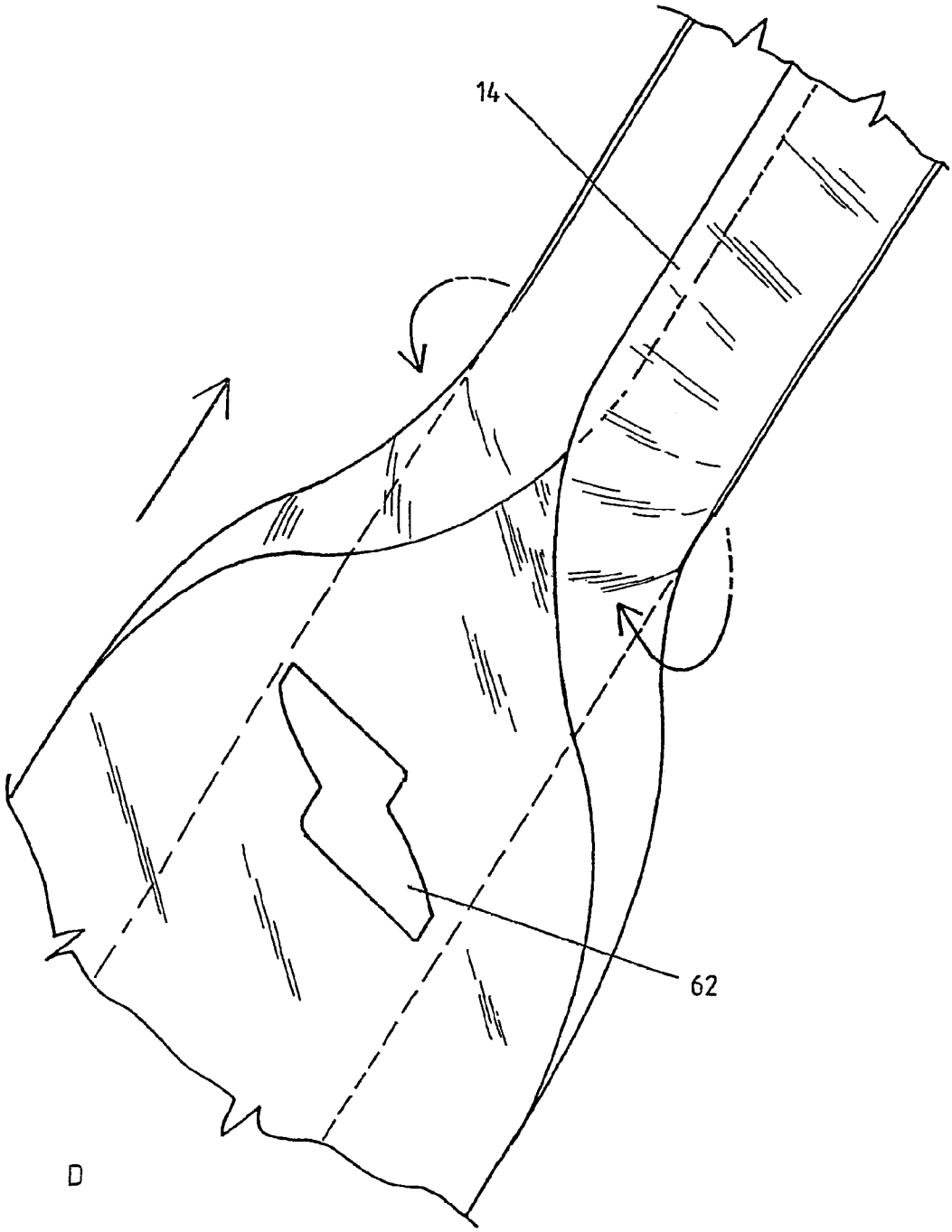
FIGS. 7 and 8 are enlarged showings of essential steps in the manufacturing process illustrated in FIG. 6.
Figure 8:
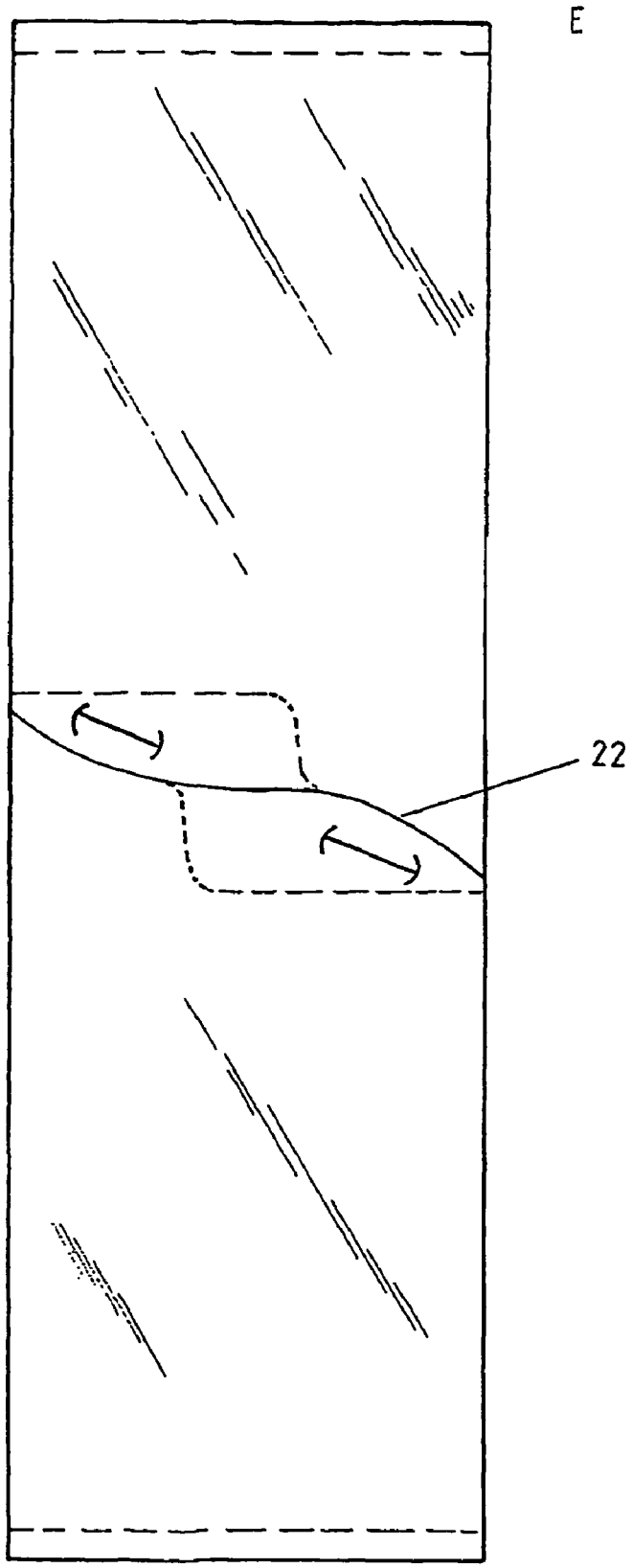

FIG. 6 outlines the essential steps in a method for production of a container in accordance with the thus illustrated embodiment of the invention. The process originates at point A where multiple lengths of container material, illustrated here as sheets of paper 58, are fed through longitudinally spaced pairs of rollers 60 into layered alignment as shown at point B. Prior to folding at point D where the paper laminae is formed into a substantially tubular body and sealed along the seam 14 thereof, the reinforcement insert 36 is inserted as shown (refer particularly to FIG. 7, noting the preferred central location of the insert). In the illustrated embodiment the insert 36 is of cardboard manufacture, stamped as a mirror duplicate 62 from a transversely moving cardboard supply reel by cutting means 64 at point C, and provided with adhesive means (not shown) for attachment to the container wall 66. Downstream at point E the container material is divided into sections by spaced cutters 68 and 70, and the container handle formed by cutting out a finger grip profile 34 (profile cutter not shown). The first cutter 68 is positioned substantially obliquely to the direction of material travel and shape cuts the material 58 and mirror duplicate insert 62 along line 72 to form the mirror image top end sections 16 of the adjacent container sections (refer particularly to FIG. 8). The second cutter 70 straight cuts the material along line 74 substantially transverse to the direction of material travel to form the straight cut bottom ends 18 of adjacent containers 10. Multiple containers are thus formed. Further processing of the containers occurs downstream of point E. The container bottom ends 18 are closed by any of the various closure methods disclosed in the art. For this embodiment, closure of the container top end is completed by folding the closure means 42 along fold lines 50, 52 and 54.

To facilitate container filling at least one of the said container ends 16, 18 must remain at least partially open or alternatively be fitted with a valve. The filling method determines how the manufactured container 10 is supplied for filling. For example, in gravity feeding the contents are typically introduced through the container bottom end 18, whereas in spout filling either the top end spout 40, or alternatively, an auxiliary spout provided in the said bottom end 18 is used.

Figure 9:
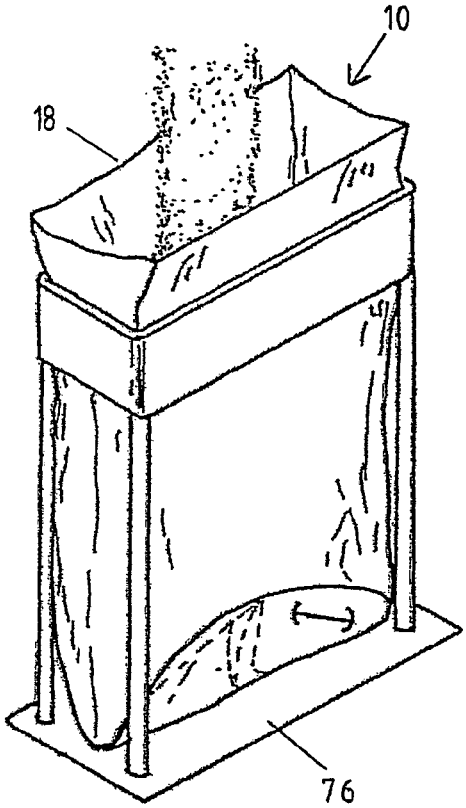
FIG. 9 illustrates a preferred method for container filling in reference to the container embodied in FIG. 1.
Figure 10:
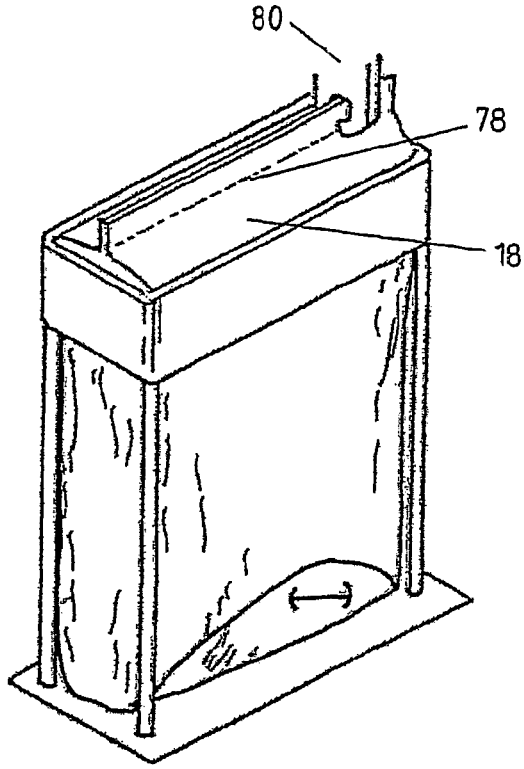
FIG. 10 illustrates a preferred method for closure of the container filled by the method of FIG. 9.

FIG. 9 shows the container 10 inverted and held in a support 76 being gravity fed through the open bottom end 18 with the top end 16 thereof closed. After filling the bottom end 18 is sealed by an appropriate closure means. The bottom end closure means of the container illustrated in FIG. 10 is in the form of a heat seal 78 applied by sealing instrument 80.

Figure 11:
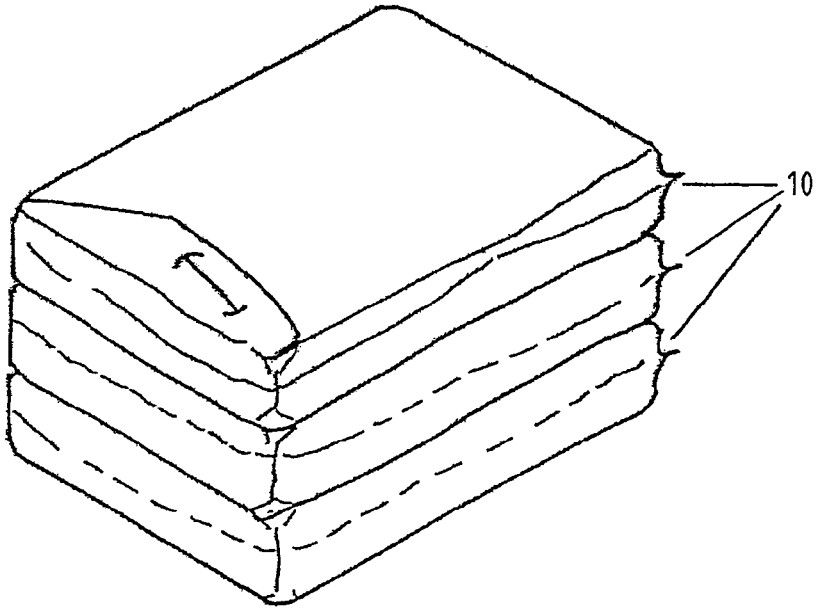
FIG. 11 illustrates the configuration and stacking potential of multiple filled containers in reference to the container embodied in FIG. 1.

As illustrated in FIG. 11, upon filling and closure, the container configuration is substantially block shaped and adapted for efficient stacking.

Referring now to FIGS. 12 through 27 there is illustrated a container according to a second preferred embodiment of the present invention distinctly formed by a substantially z-shape oblique cut 82 applied to the top end of a gusseted container body 84.

Figure 12:
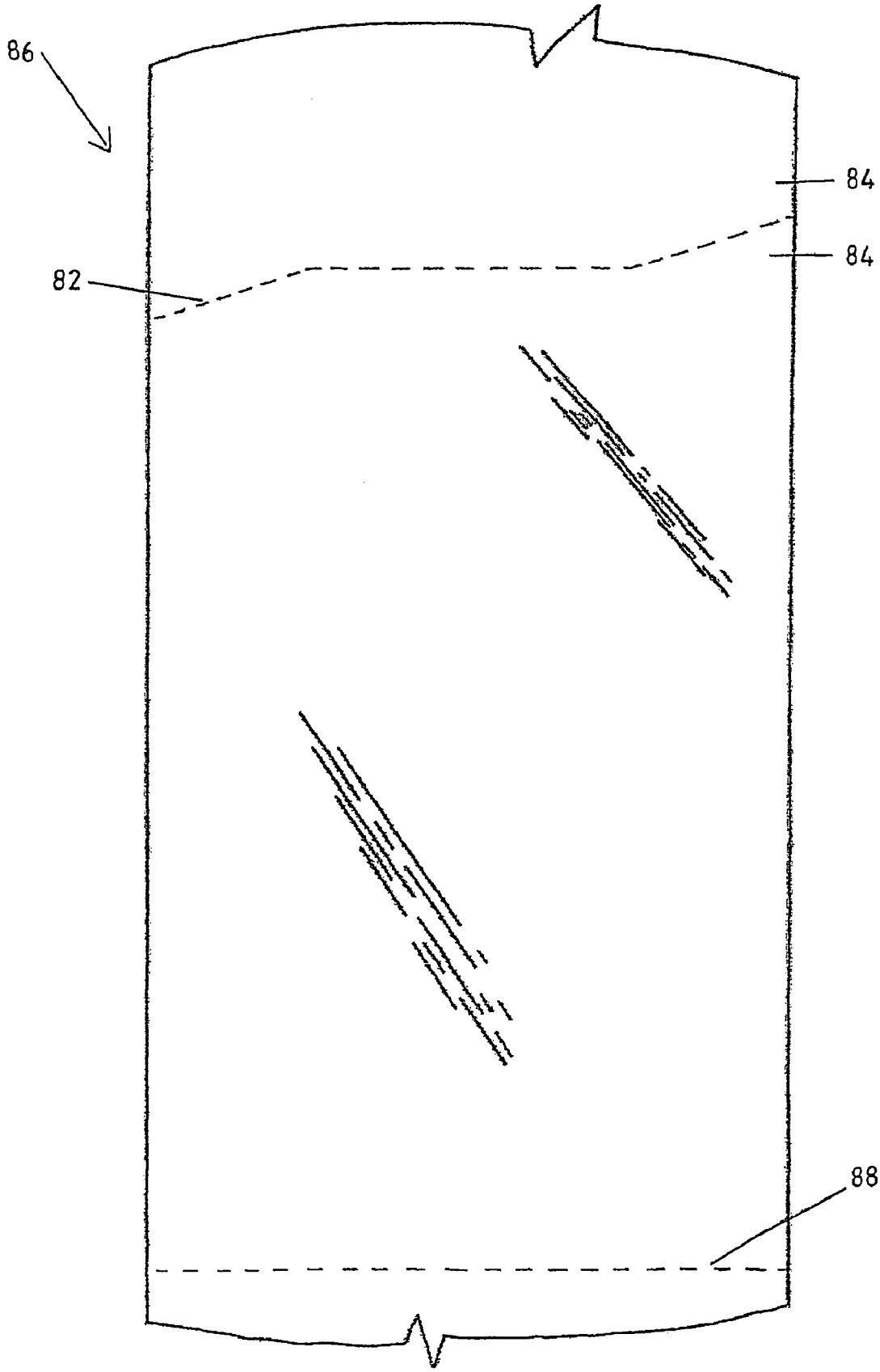
FIGS. 12 to 19 comprise front elevations which illustrate the formation of a container according to a second embodiment of the present invention.
Figure 13:
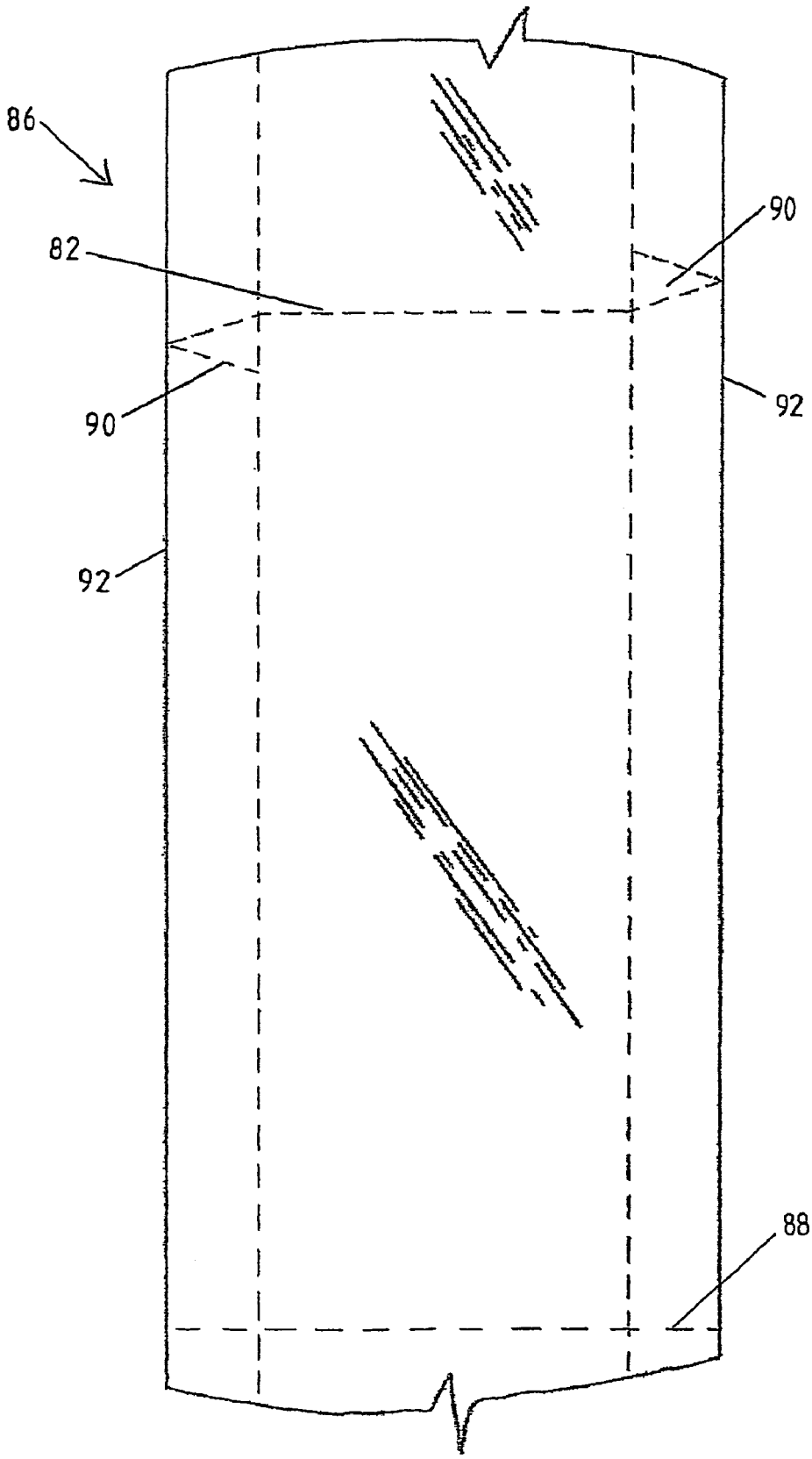
Figure 14:
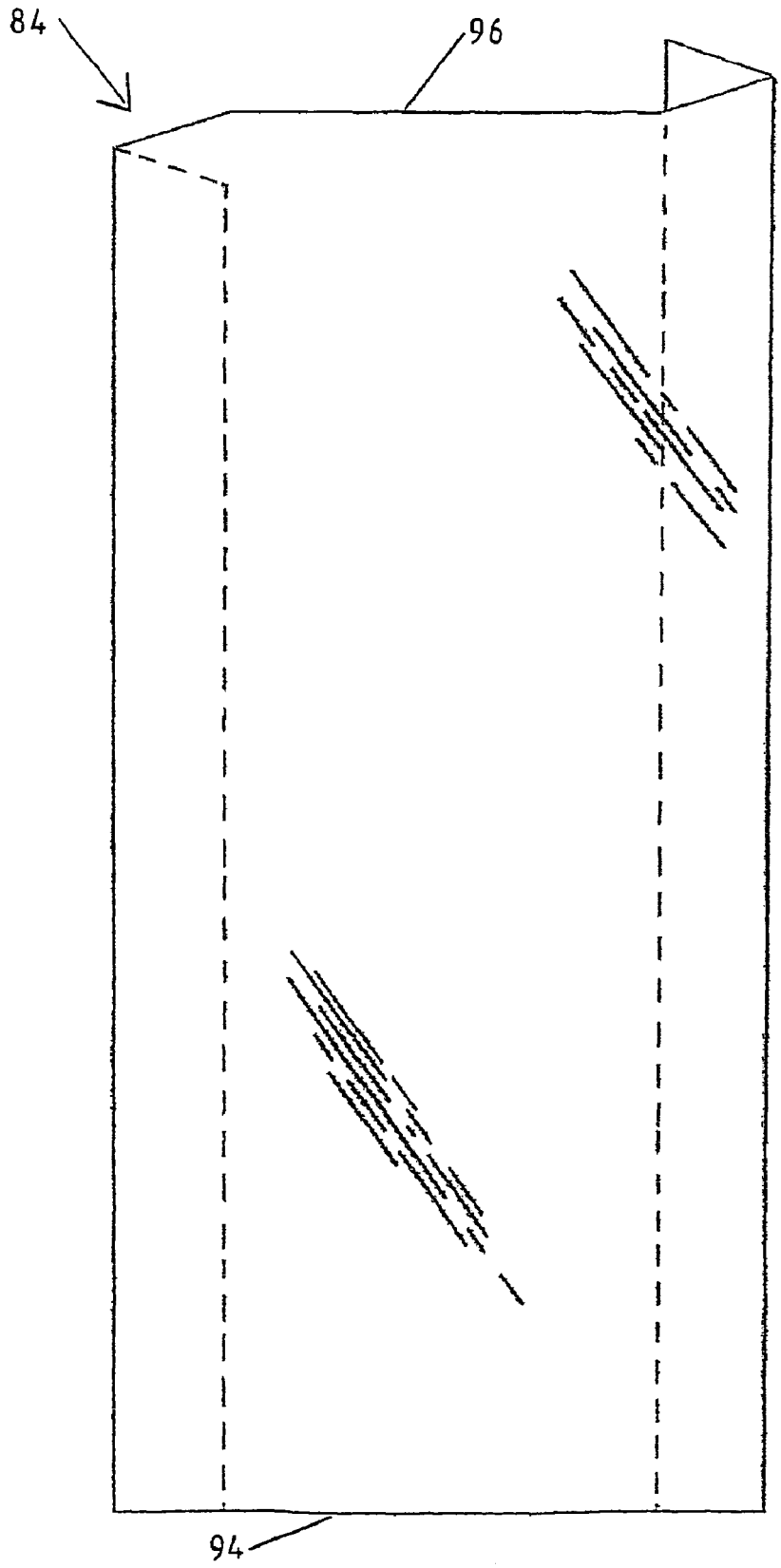

FIGS. 12 to 19 illustrate the formation of containers according to the second preferred embodiment of the invention from a tubular body of material 86. As shown in FIG. 12 the tubular body 86 is first perforated with alternate shaped 82 and straight 88 perforation lines to define respective container body sections 84. The tubular body 86 is then gusseted by folding in side edges 90 to form crease lines 92. Following gusseting the tubing is torn along the perforations 82 and 88 to separate the respective container sections 84 as illustrated in FIG. 14, each container comprising a straight bottom end 94 and z-shaped top end 96 defining closure 98, discharge 100 and carrying means 102.

Figure 15:
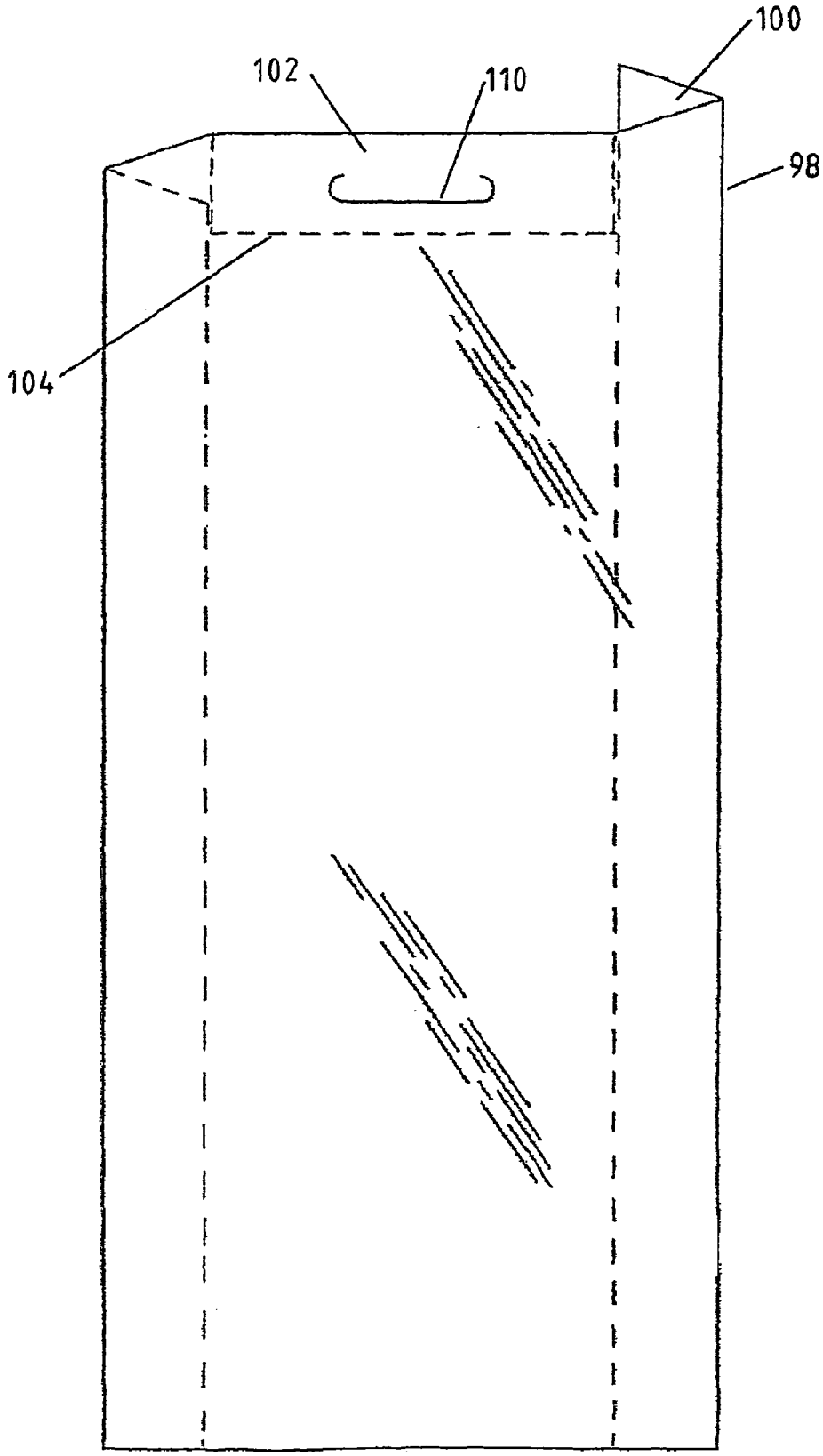

As shown in FIG. 15 the container carrying means 102 is fitted with a reinforcement in the form of an insert 104 located intermediate the gusset side edges 106 and 108 and cut at 110 to form a handle with finger grip means.

Figure 16:
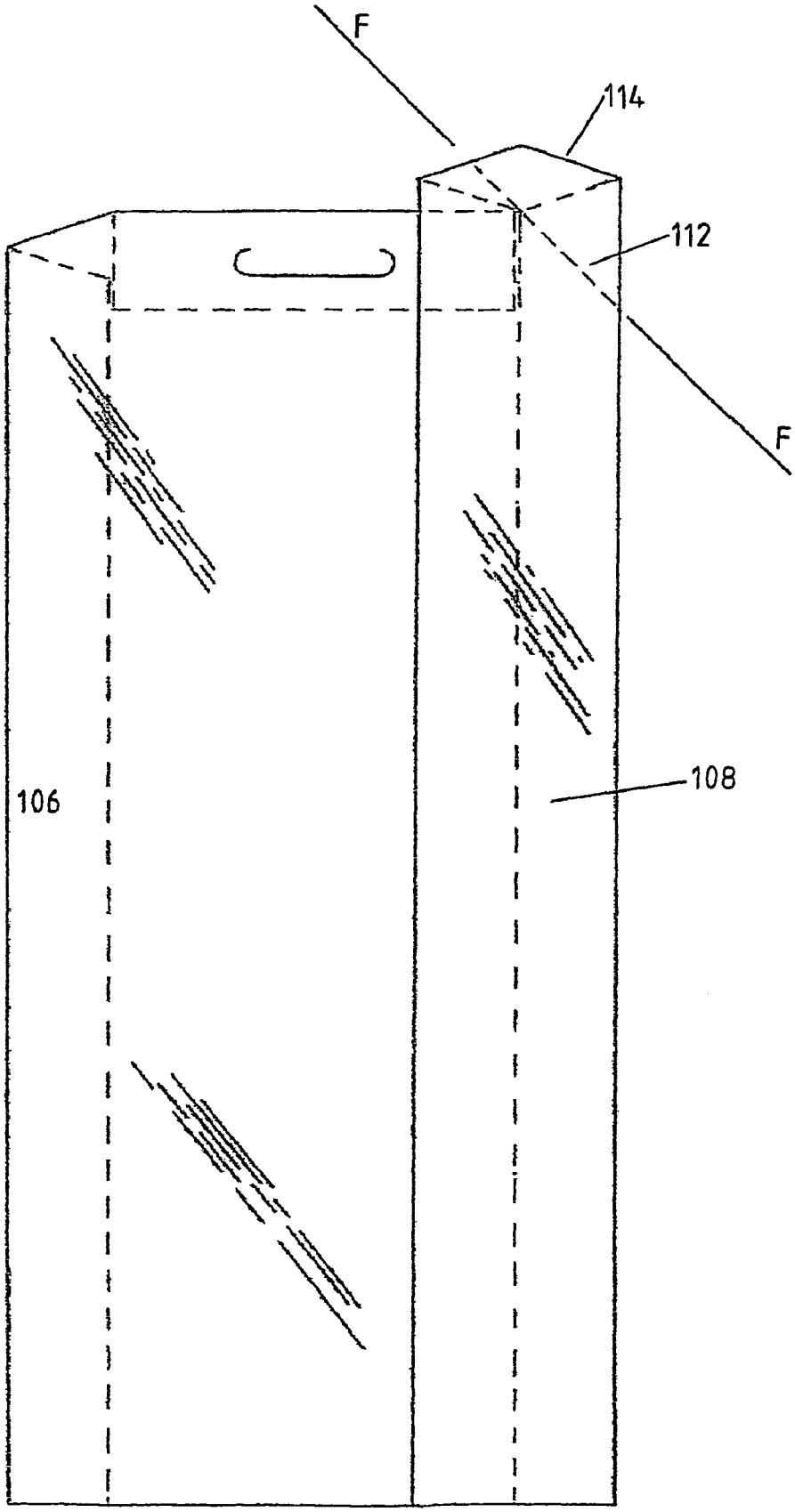
Figure 17:
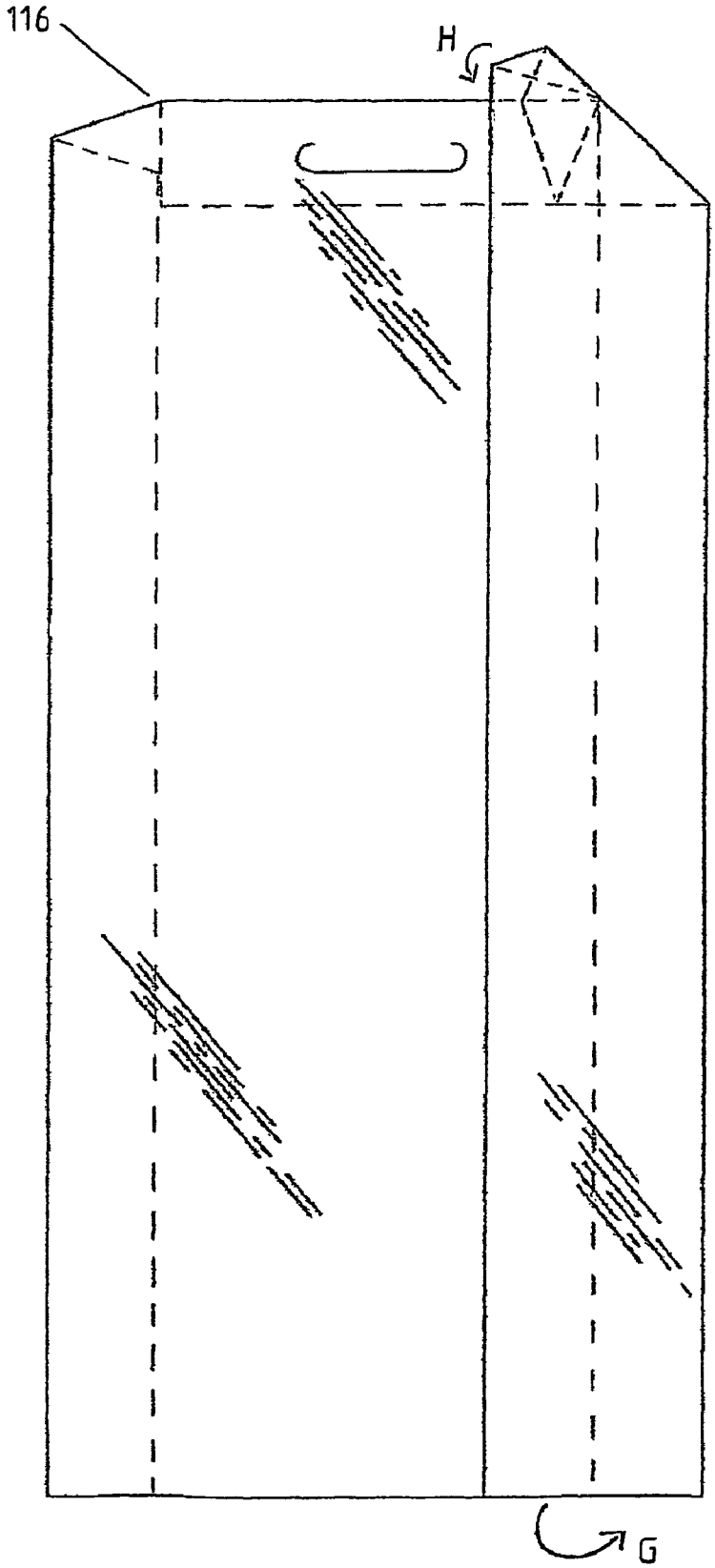
Figure 18:
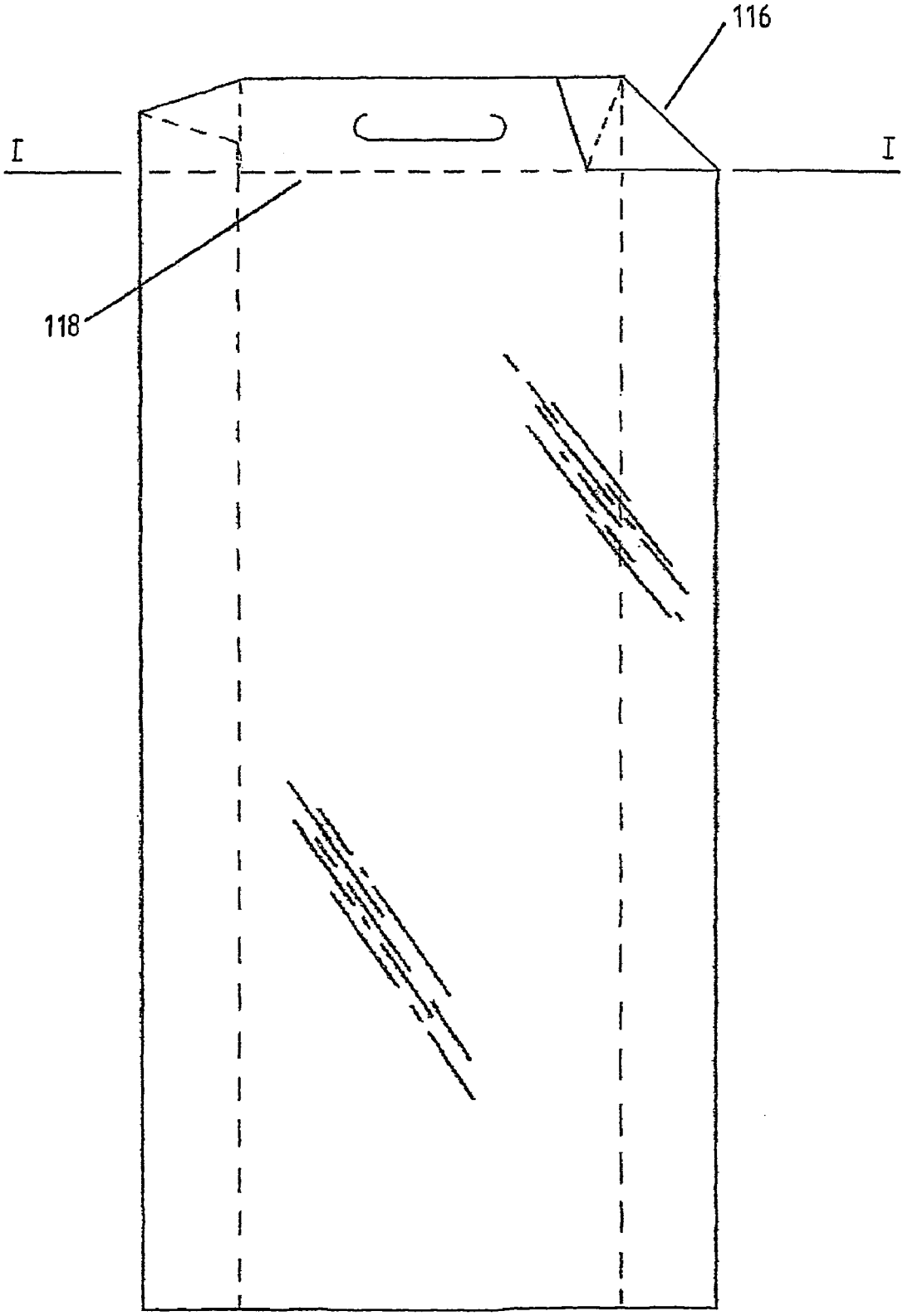
Figure 19:
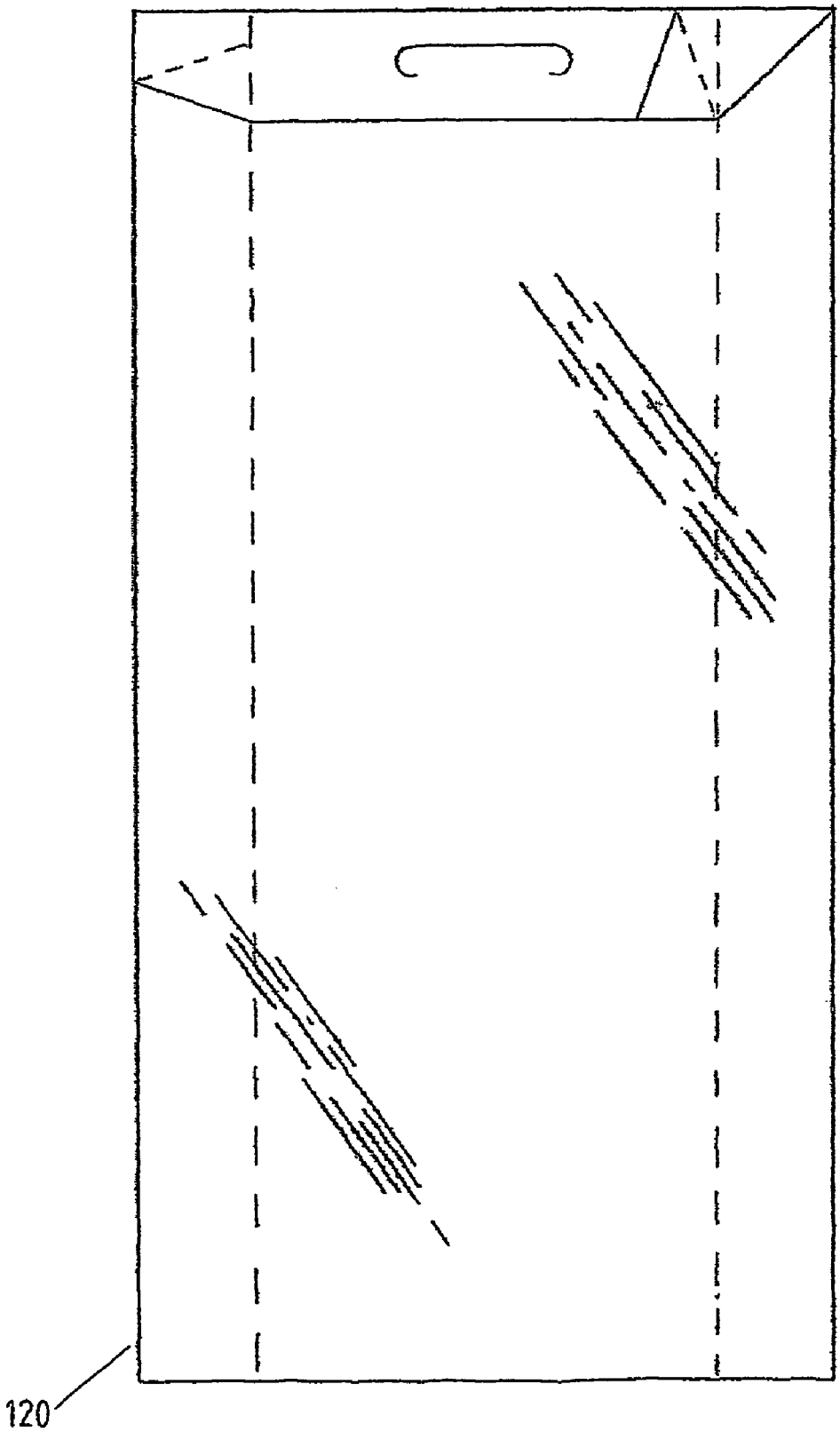

Formation and closure of the closure means 98 is illustrated in FIGS. 16 to 19. Referring to FIG. 16 the discharge side gusset 108 is opened to form crease line 112 in the discharge pouring spout 114 by folding along line F. The discharge side gusset 108 is then folded back out as shown by arrow G and closure of the discharge means 100 effected as the pouring spout folds down over the container top end 116 as shown by arrow H. The container top end 116 is then optionally folded down along line I forming a further crease line 118 to facilitate closure of the container into a substantially block shaped configuration as illustrated in FIG. 19. Closure of the container bottom end 120 is not shown but may be effected by any suitable closure in the art.

Preferred methods and apparatus for manufacturing the said second preferred container embodiment are illustrated in FIGS. 20 to 27.

Figure 20:
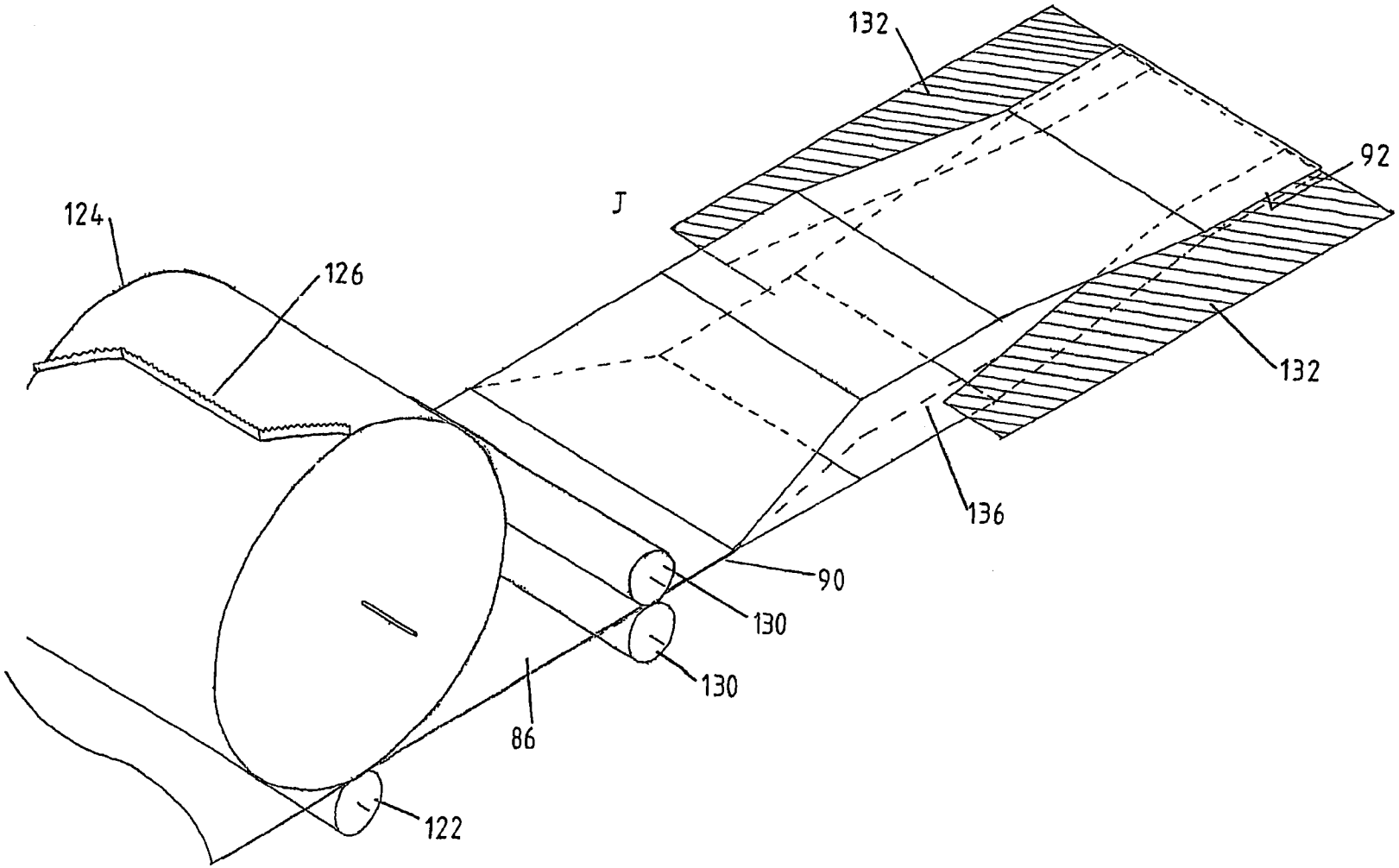
FIGS. 20 to 27 illustrate the preferred apparatus and method for manufacturing the container according to the second embodiment of the present invention.
Figure 21:
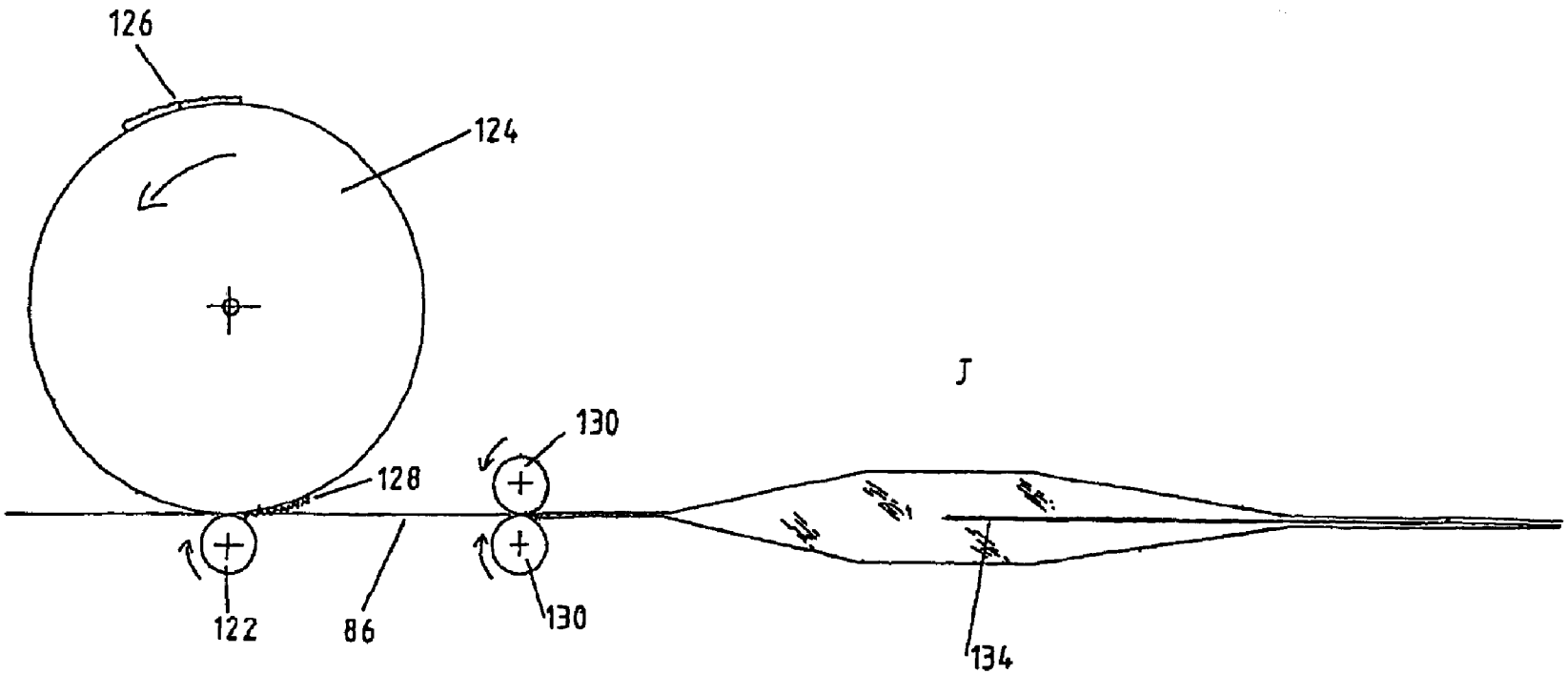

FIGS. 20 and 21 illustrate tube perforation and gusseting. As shown, the tube is passed between a roller 122 vertically spaced from a rotary perforator 124 which is fitted with oppositely disposed projecting shaped and straight profile perforating means 126 and 128. Upon rotation of the perforator the said respective perforating means 126 and 128 alternately contact and perforate the tube. The perforated tube 86 is then guided through spaced rollers 130 and is expanded at J by a rigid forming surface (or alternatively by wheels which follow substantially the same contours as the said forming surface) for side edge gusset formation. The gussets are formed in the tube sides as the tube passes between spaced arms 132 of a rigid former 134 (or alternatively by rollers which follow substantially the same contours as the said forming surface). The former arms gradually taper inwards forcing the tube side edges 90 to inwardly converge to form longitudinally extending side recesses 136 whereupon the tube is pressed (suitably by means of rollers) from top and bottom onto the former 134 to form crease lines 92 defining the newly formed gusset side edges.

Figure 22:
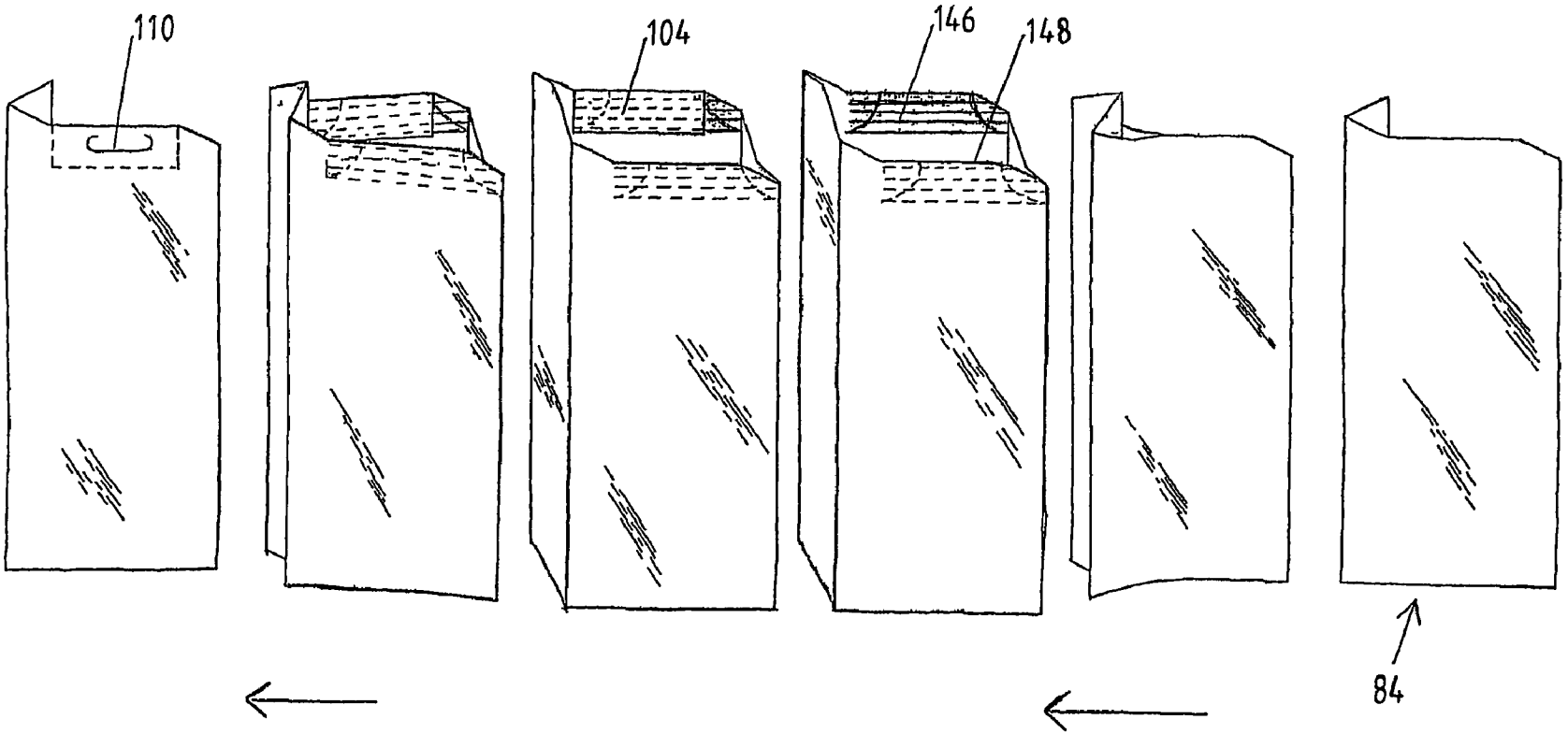
Figure 23:
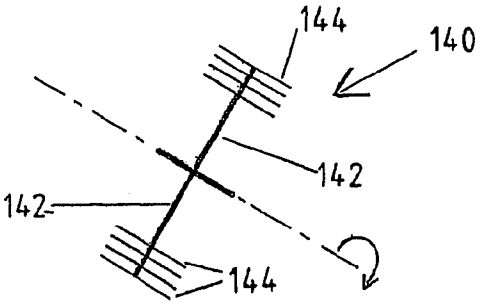
Figure 24:
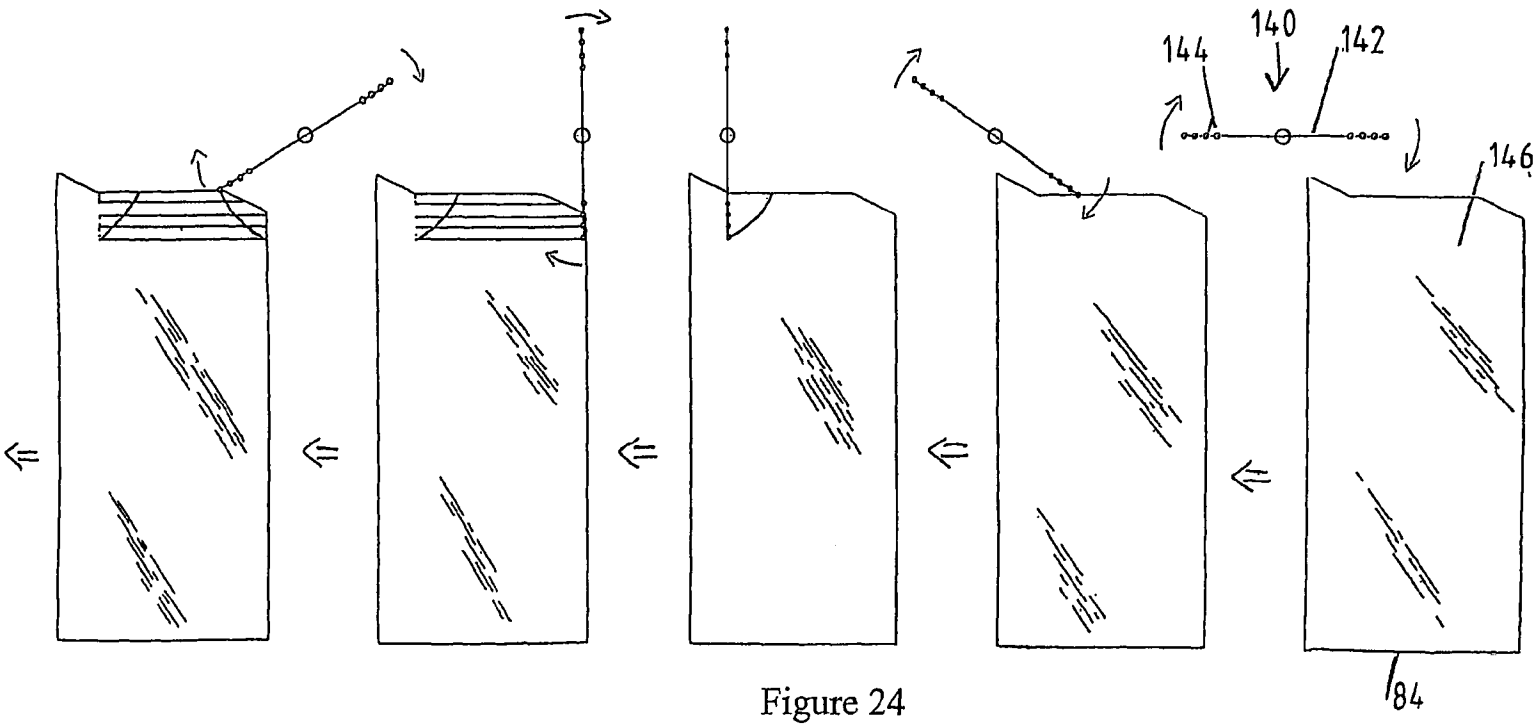
Figure 25:
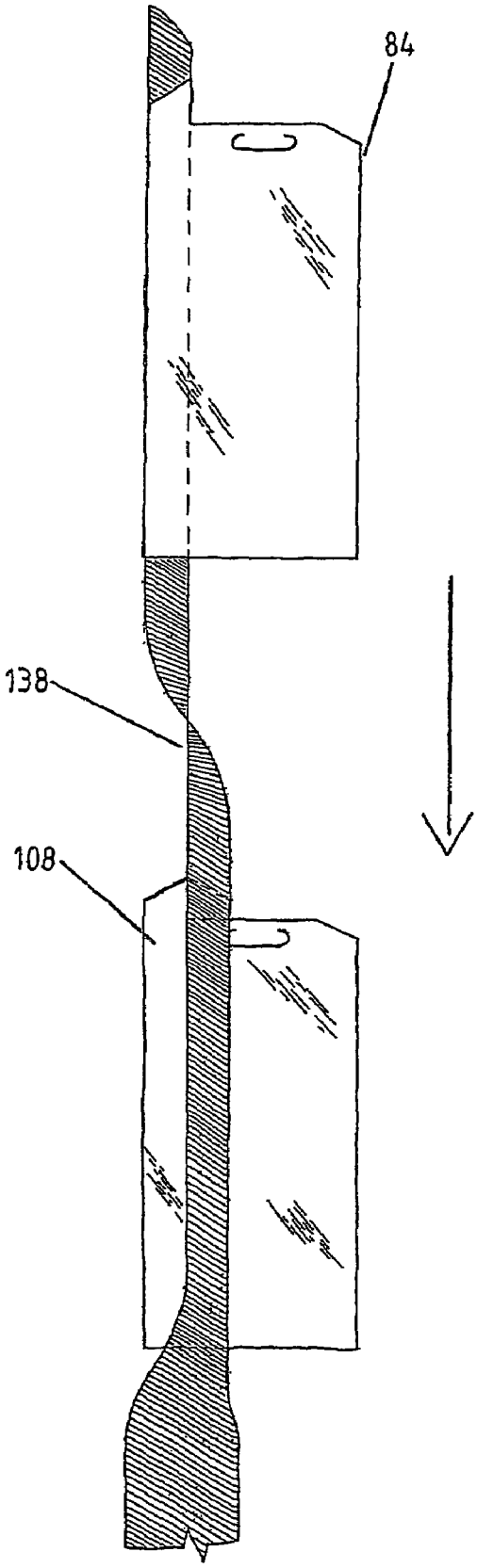
Figure 26:
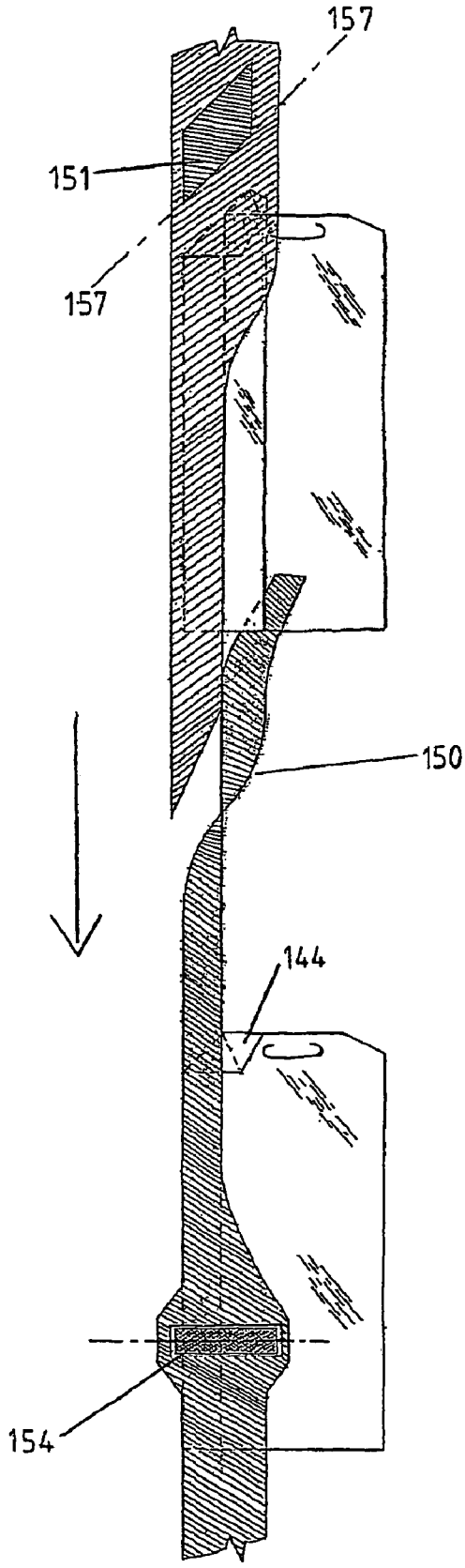
Figure 27:
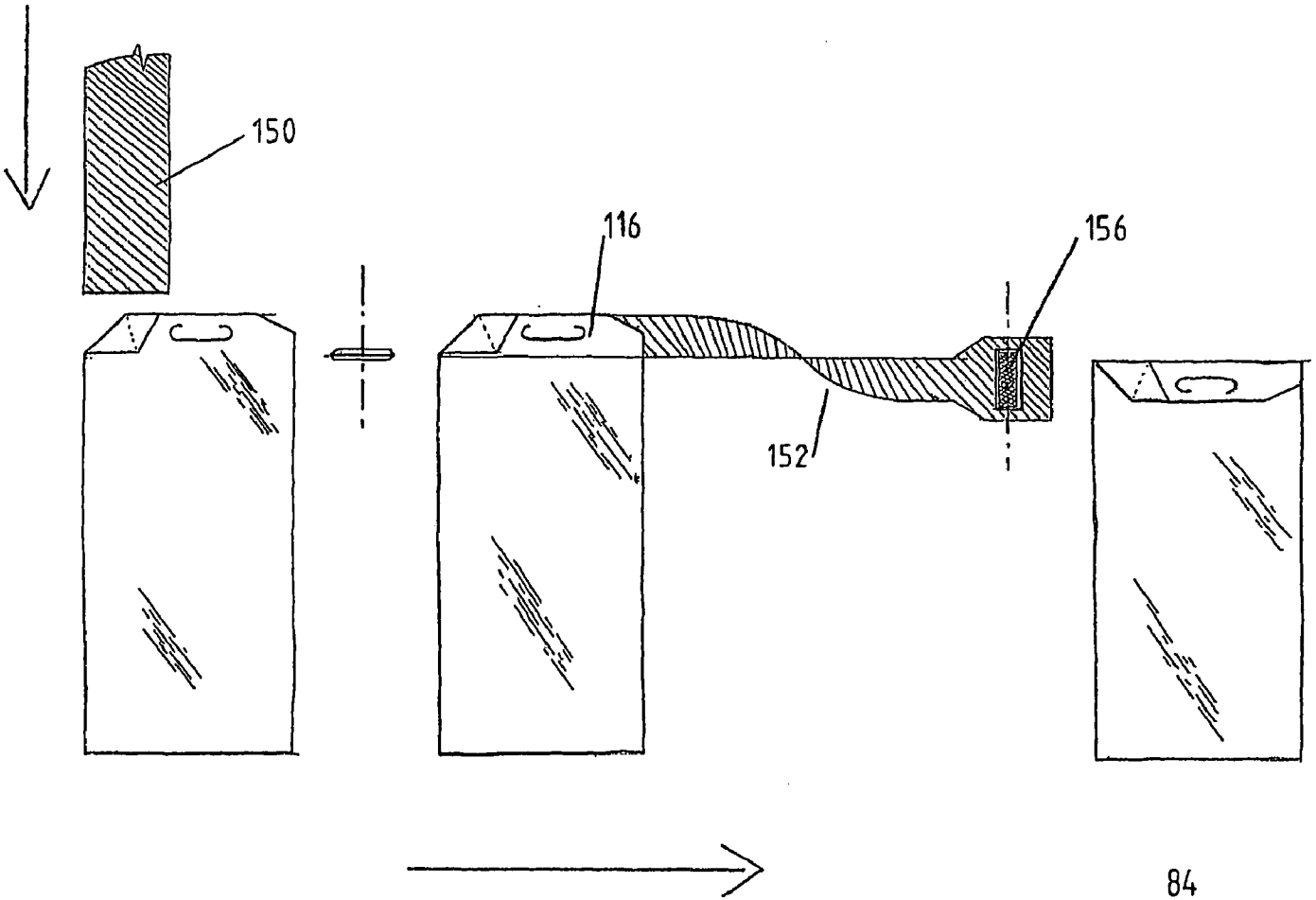

Once the tube is separated along perforation lines 82 and 88 to form the respective container sections 84, each container is then expanded open, glue applied and the reinforcement insert 104 positioned and stamped in the container, this sequence being illustrated in FIG. 22. With reference to FIGS. 23 and 24 there is shown a preferred apparatus and method respectively for glue application. The apparatus comprises a pivotally mounted applicator 140 comprising a pair of oppositely disposed arms 142 each carrying a plurality of individual glue applicators 144 (four shown). Use of the apparatus 140 of FIG. 23 on the moving expanded container 84 involves concurrent glue application to both of the respective container inner walls 146 and 148 as illustrated in FIG. 24. Once the container parts are glued and the insert positioned, the container is collapsed, the glue bond secured by forcing a roller or wheel press over same (not shown), and the handle finger grip section 110 cut out of the carrying means. FIG. 25 illustrates containers opening after gluing and insert positioning by processing same through a first corkscrew drive mechanism 138 for opening the container gussets 106 and 108. As illustrated in FIGS. 26 and 27 the container discharge pouring spout 114 and top end 116 are then folded by respective second 150 and third 152 corkscrew drive mechanisms, glued (not shown) and secured closed by wheel presses 154 and 156. The folding mechanism for effecting closure of the container pouring spout further includes an angled block 151 that folds the top end along lines 157 as shown in FIG. 26.

The container as manufactured may then be supplied for bottom end filling. It is to be noted that the above manufacturing method can be modified for containers of different material construction, the above disclosure particularly suiting paper bag manufacture. For example, the production of plastic bags may be simpler as heat sealing rather than gluing can effect closure and the carrying means can be supported by reinforcing the handle as opposed to positioning an insert therein.

FIGS. 28 to 31 illustrate a container according to a third embodiment of the invention comprising a multi-wall container 158 defined by an obliquely orientated stepped top end closure 160.

The term "multi-wall" refers to a container formed by tubing two or more plies of paper or other material for container manufacture, and arranging the tubes in telescopic relation.

Figure 28:
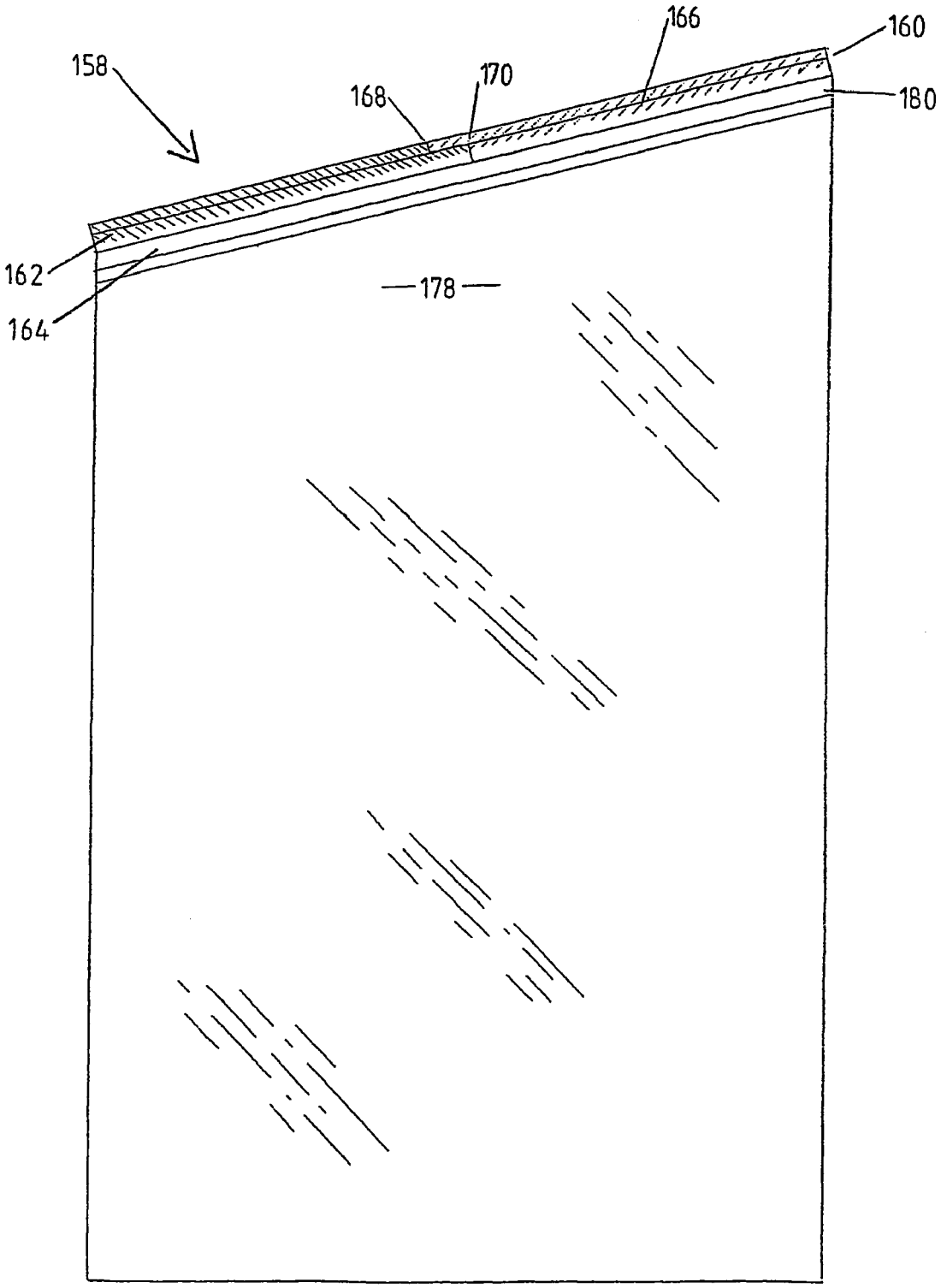
FIG. 28 is a front elevation view of a container according to a third embodiment of the present invention shown in a manufactured form with closure means open.
Figure 29:
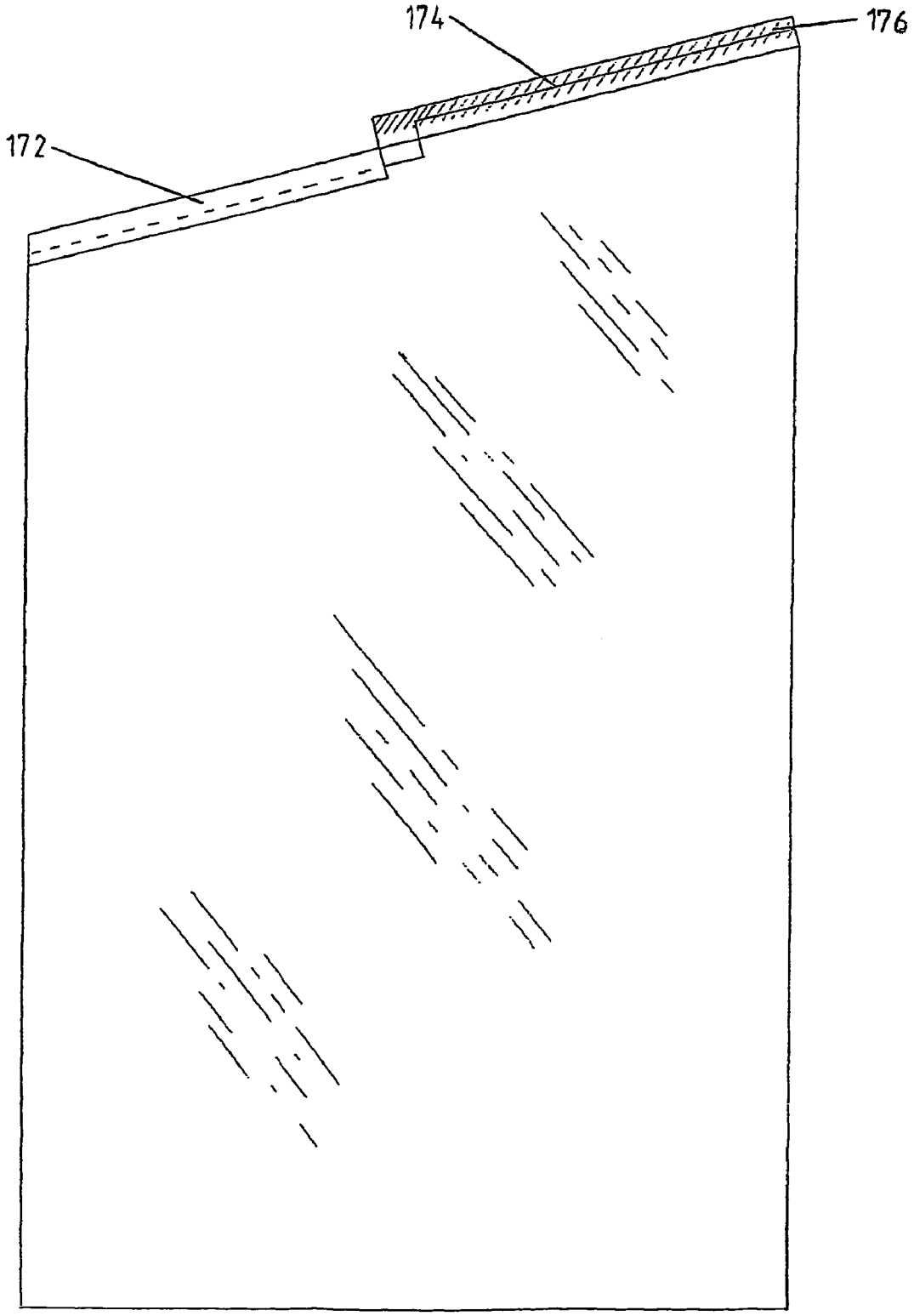
FIGS. 29 to 31 illustrate closure of the discharge means and top end section of the container embodied in FIG. 28.
Figure 30:
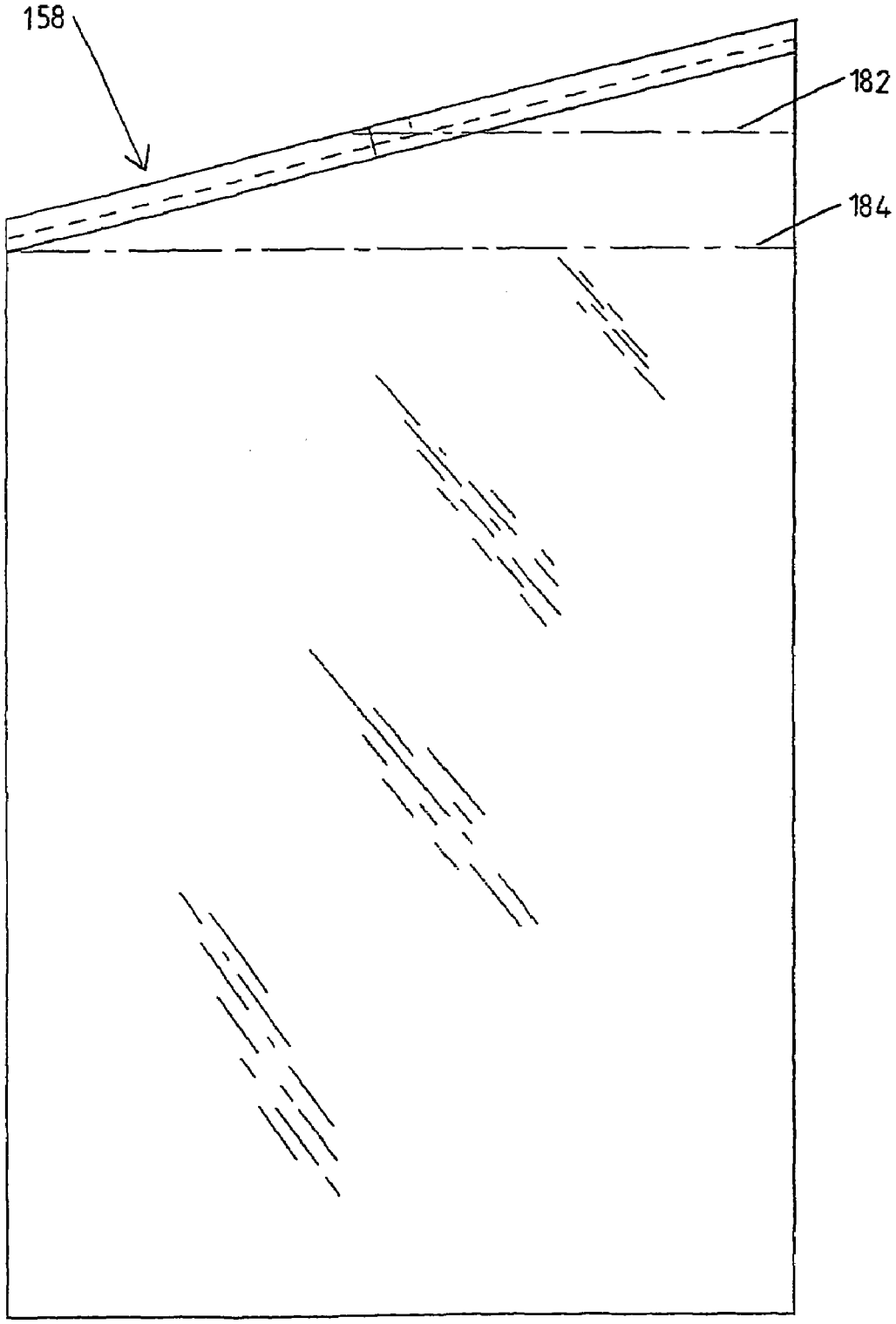
Figure 31:
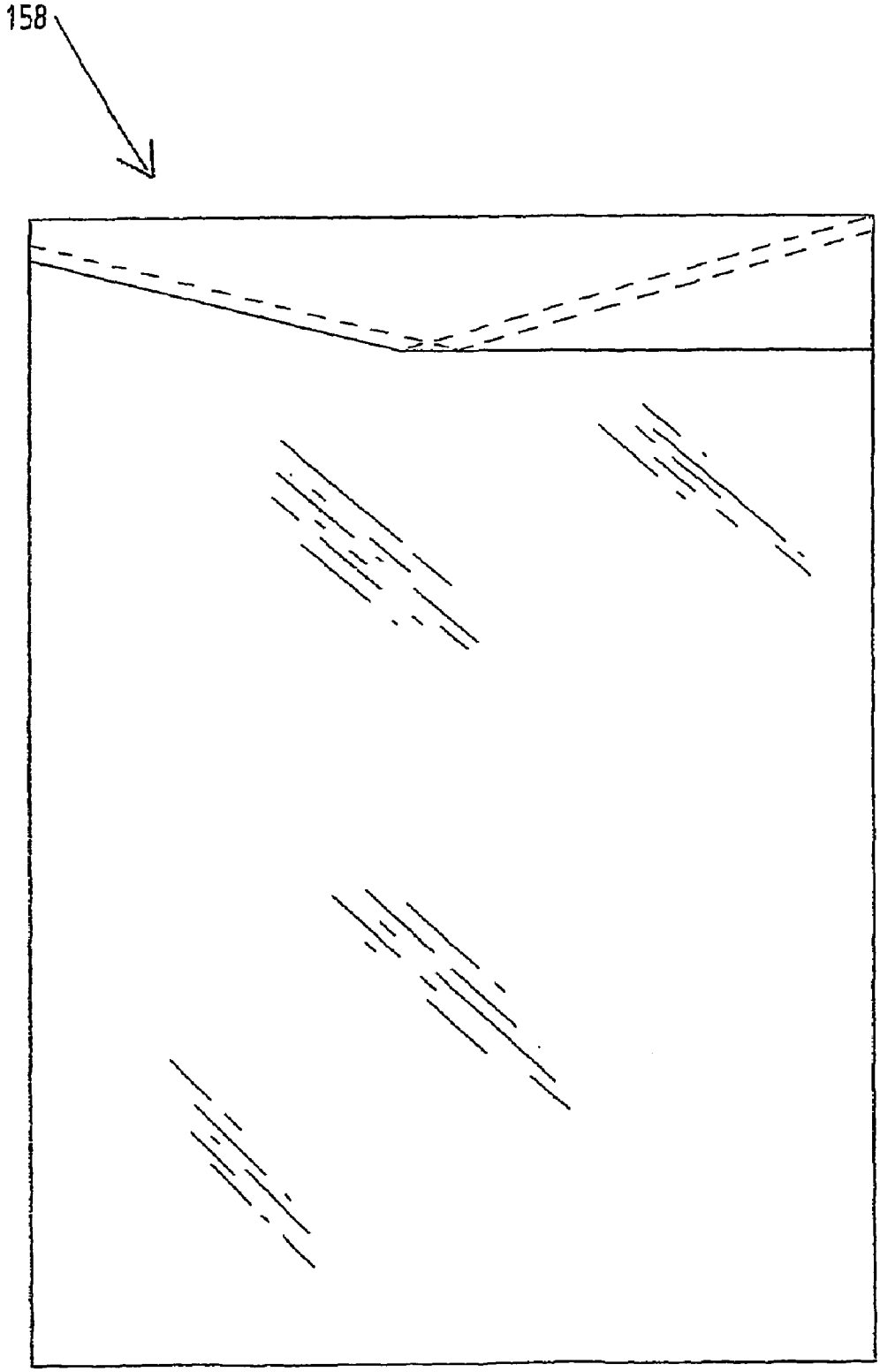

As shown in FIG. 28 the container 158 comprises two tubes dimensioned to form an inwardly stepped container rear wall 162 and an outwardly stepped container front wall 164, wherein the rear wall 162 is extended relative to the front wall 164 to form a first foldable closure means comprising a flap 166. The flap 166 may be sectioned by making vertical cuts 168 and 170 in the top ends of the respective tube back walls. As shown it is preferred that the cuts be offset to provide more secure sectional closures 172 and 174. The closure includes securing means in the form of a re-usable glue 176 applied to the inner side of the container rear wall. The container open top end 178 forms the discharge means including a pouring spout 174 comprising the extended tapered end 180 defined by the top end oblique cut. The discharge means is selectively sizable as shown in FIG. 29 by sectional permanent closure 172. If preferred different glue types can be applied to the distinct closure sections. In the illustrated embodiment a permanent glue is applied to section 172 and a re-sealable glue to section 174. As shown in FIG. 30, the container includes fold lines 182 and 184 forming a second closure means to effect full closure of the container and formation into a substantially compacted configuration as shown in FIG. 31.

Referring now to FIGS. 32 to 40 there is illustrated a reusable container according to a fourth preferred embodiment of the invention.

Figure 32:
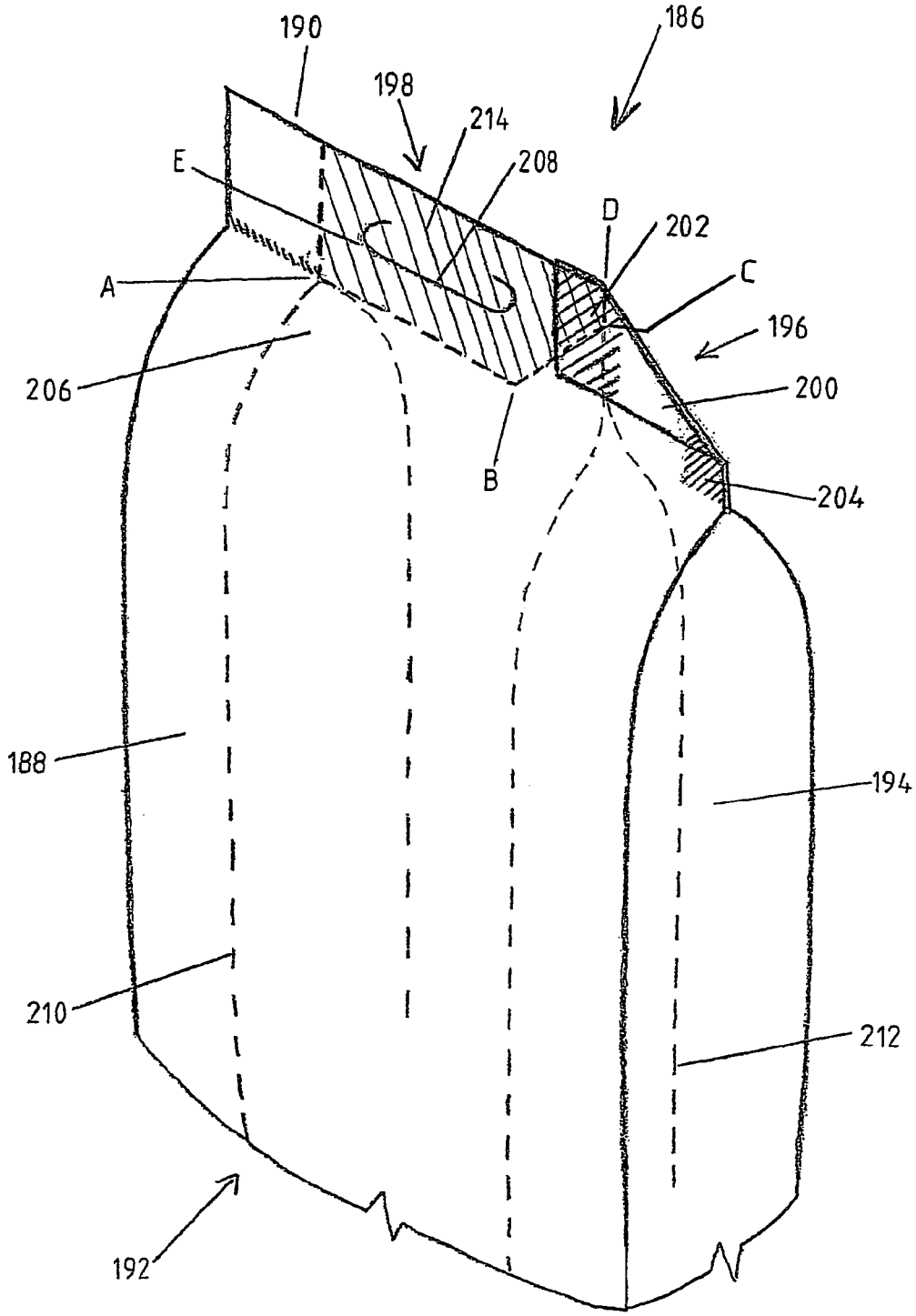
FIG. 32 is a partial perspective view of a container according to a further embodiment of the present invention wherein the container is shown closed.

As shown in FIG. 32, the container is in the form of a multi-wall bag 186 including a tubular body 188, a top end 190, a bottom end 192 (not fully shown) and gusseted side edges 194. The container top end is an openable end having integrally formed sectional closure means including an openable section 196 and a closed section 198. The openable section 196 incorporates discharge means in the form of an extended pouring spout 200 shown retracted with said openable section being folded into closed formation and secured with glue to the container as represented by shading at 202. Additional securing has been provided by means of glue at 204 to improve closure of the openable section by securing gusset side edges. Although not shown, a length of adhesive tape (not shown) may be applied across the closed openable end as additional tamper evidence. As shown in outline, the container 186 incorporates support means in the form of an insert 206 to reinforce the container closed section which includes carrying means in the form of a handle at 208. The insert 206 comprises two pieces of paper 210 and 212 glued together at the top ends thereof with glue in the area shown at 214. During the lamination process the insert is glued together in the closed section area along line A-B-C-D and suitably E or alternatively throughout the area enclosed by line A-B-C-D. Importantly, glued edge C-D of the insert is to be positioned as close as possible to the discharge means side gusset. Further, the angle of glue line B-C will open or restrict the flow of contents through the discharge means as it is increased or decreased respectively. The plie is also glued during the lamination process to secure the external surfaces of the insert to the opposite inside surfaces of the inner most layer of the multi-wall bag. The glue is suitably applied as multiple continuous strips extending in the direction and length of the bag. The perforation lines to facilitate separation of each of the two plies between consecutive bags will suitably mirror the perforation lines for the respective surfaces to which they are glued.

Figure 33:
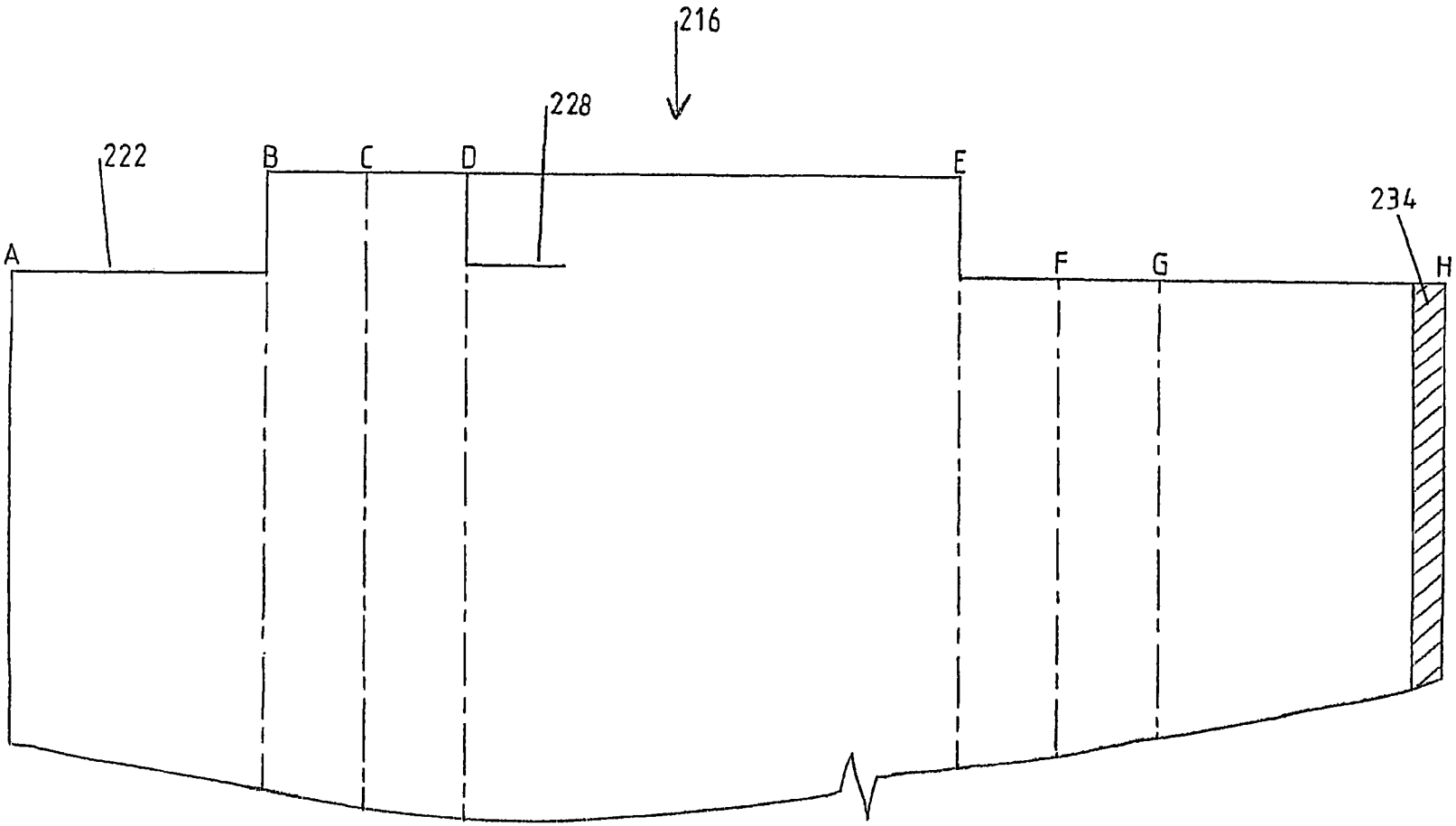
FIGS. 33 to 35 illustrate the configurations of respective walls forming the container illustrated in FIG. 32.
Figure 34:
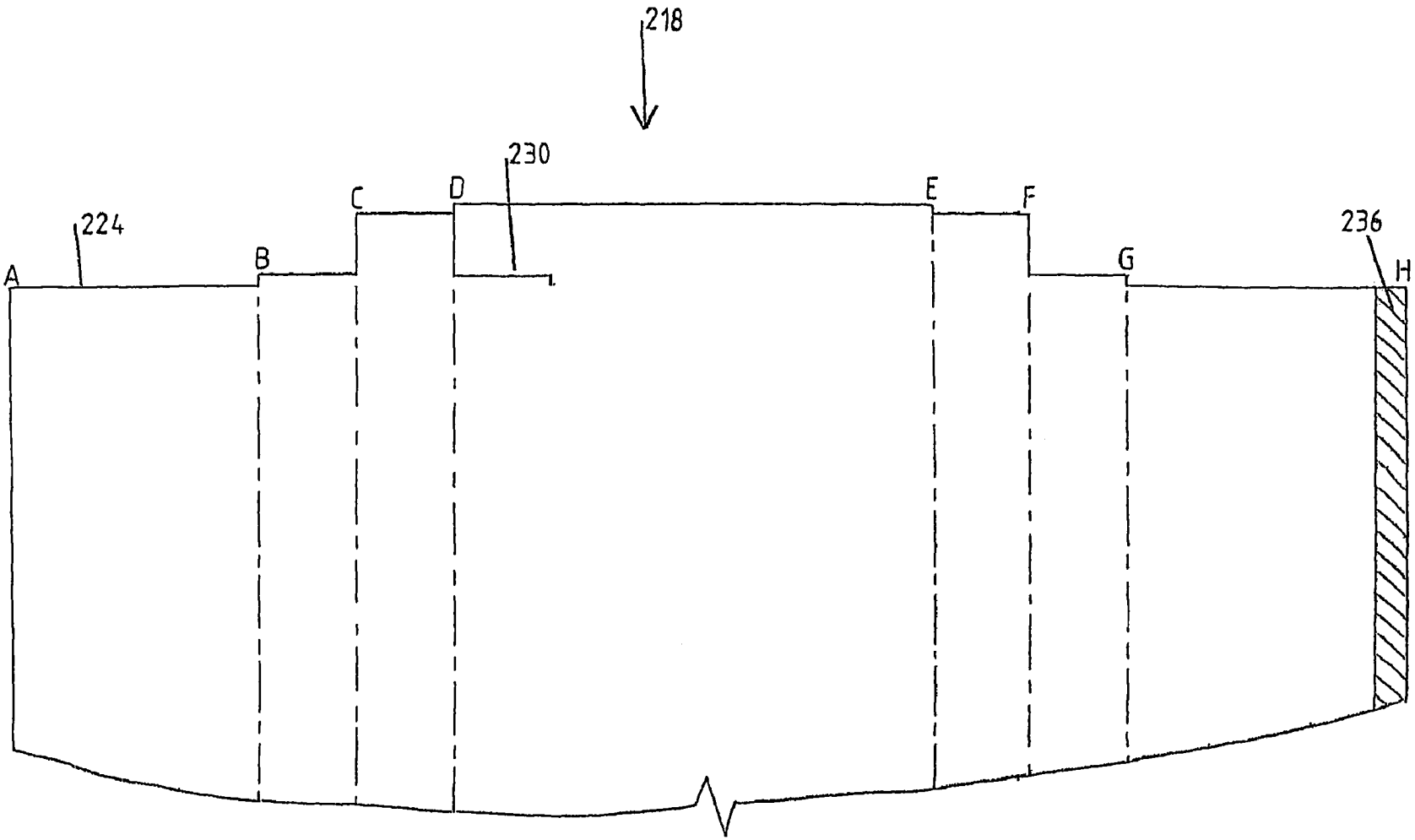
Figure 35:
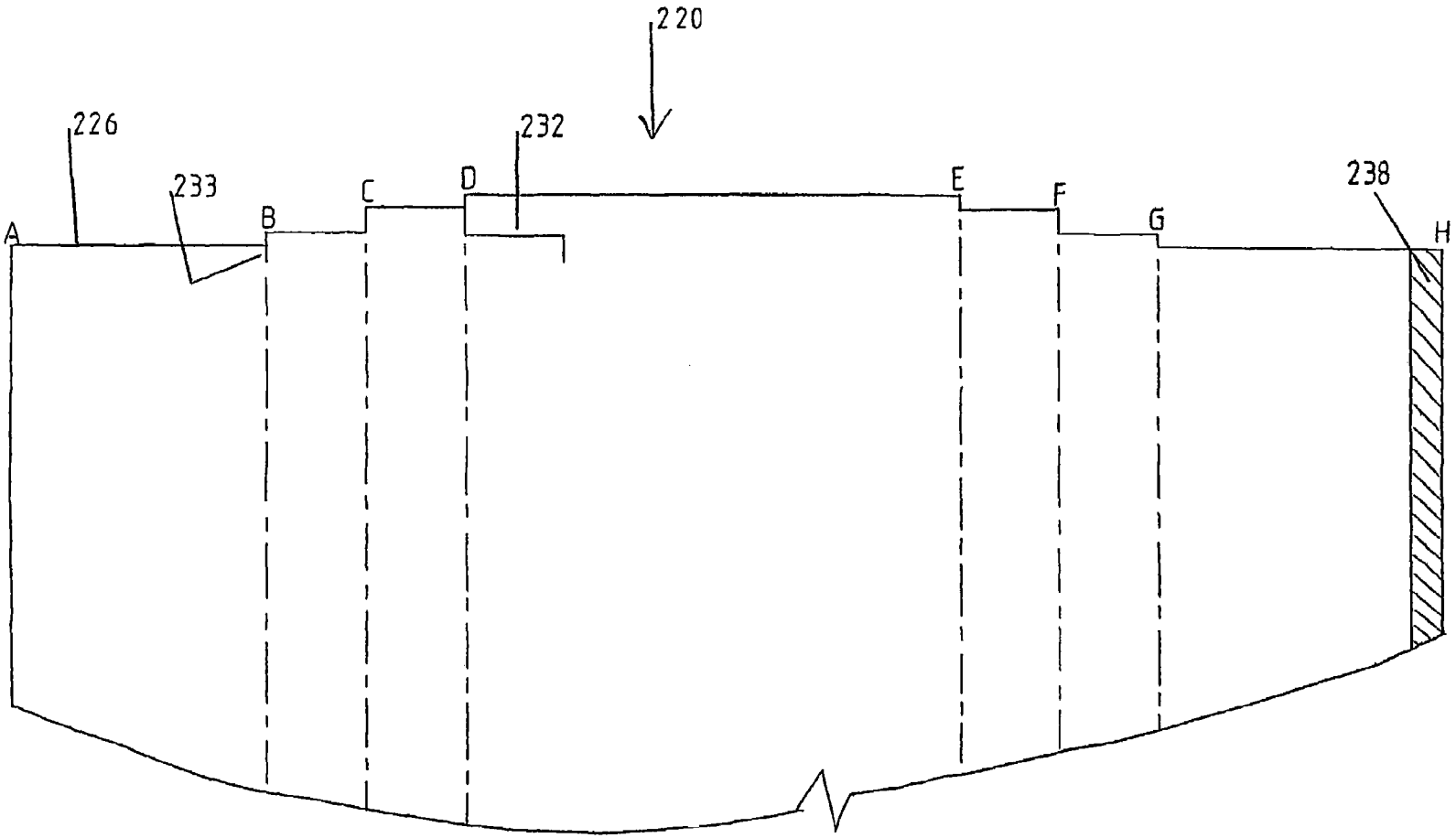

Referring now to FIGS. 33 to 35 the top ends of the respective layers or walls 216, 218, and 220 (the outer, middle and inner layer respectively) forming the container according to the fourth embodiment of the invention are illustrated.

These figures show in solid lines 222, 224 and 226 the distinct shape cuts applied to the respective top ends along with intended fold lines which are represented by dashed lines. The solid cuts made in each of the container walls are shown at 228, 230, 232 and 233. The shaded edge shown at 234, 236 and 238 on the respective walls includes securing means in the form of glue to form a longitudinal seam when mated with the opposite side edge of the respective wall. The sections defined in the respective layers by the end cut and intended folding have been identified by reference to the letters A to H for cross-reference with FIG. 36 which shows the respective layers or walls arranged telescopically and joined along longitudinal side edge (234, 236, 238) to form tube 188 for container formation.

Although not illustrated, an alternative method of container formation from laminae is preferred to that set out in relation to the second preferred container embodiment. The preferred method is distinct in that the cut lines are instead applied as perforations to respective layers of the container whilst the container is flat prior to attachment and tubing of said respective layers. As per current industry practice, once the layers are tubed, the respective containers can be separated from the tube by means of pinching. Inserts for support of the container can be incorporated in a similar manner during lamination.

Figure 36:
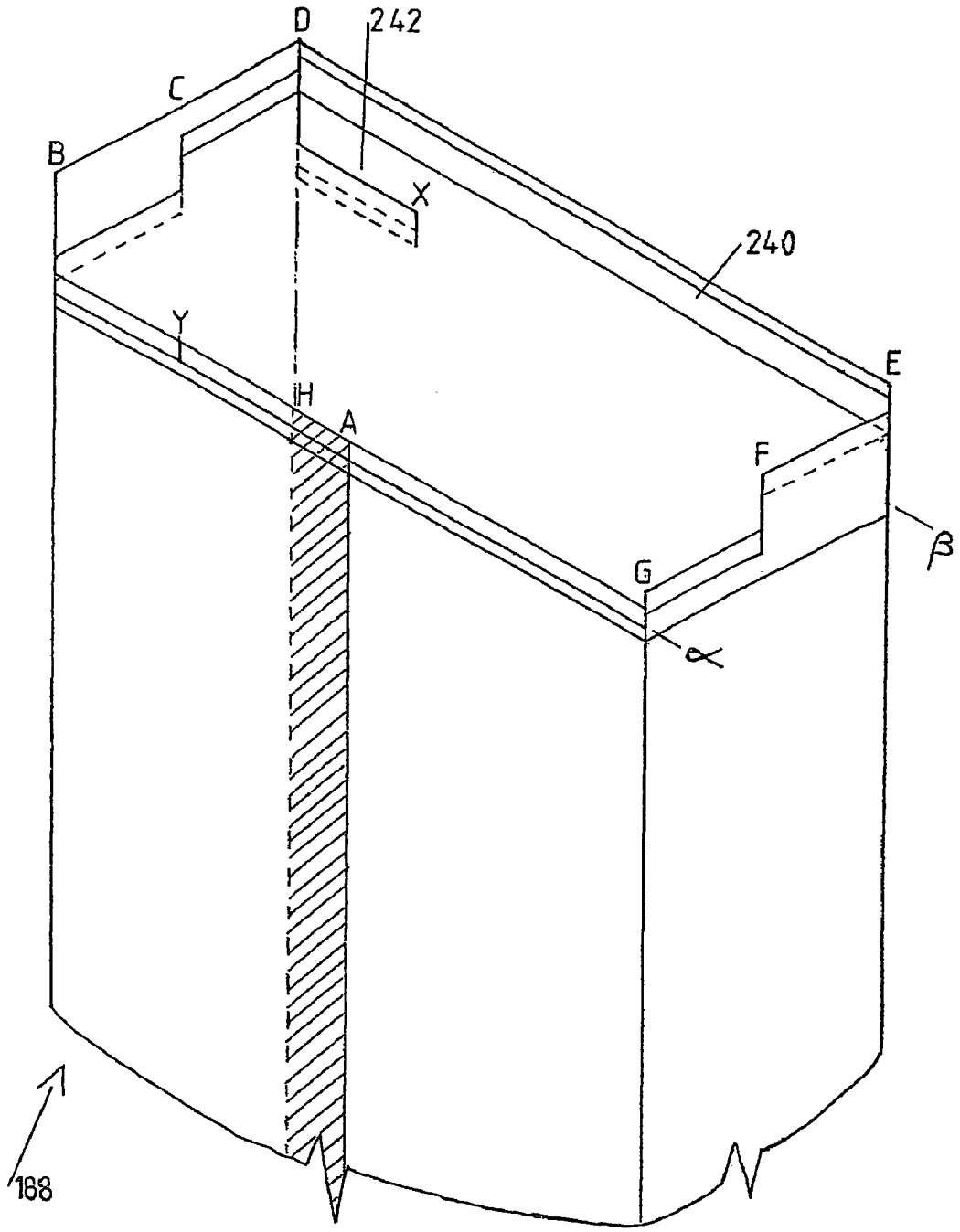
FIGS. 36 to 40 comprise partial perspective views showing the openable end of the container of FIG. 32 during key steps in container formation.

Referring to FIG. 36 it can be seen that shape cuts applied to the respective layers have defined distinct sections X-Y, E-Y and X-E in the container top end. Section X-Y is adapted to form the openable section including the discharge means of the container, whilst sections E-Y and X-E substantially correspond to the closed section of the container adapted for carrying means, with extended section D-E providing the closure 240 for said closed section.

Closure 240 is adapted to fold over the front edge of the container positioned at α by folding level to the dotted line indicated by β. Section 242 is cut so as to accommodate the discharge means/openable section to allow the closure to fold without hindrance and furthermore is adapted to reinforce the discharge means/openable section by attachment thereto.

The stepped configuration of the shaped container top end improves container closure as each of the layers/walls are exposed to the securing means.

Figure 37:
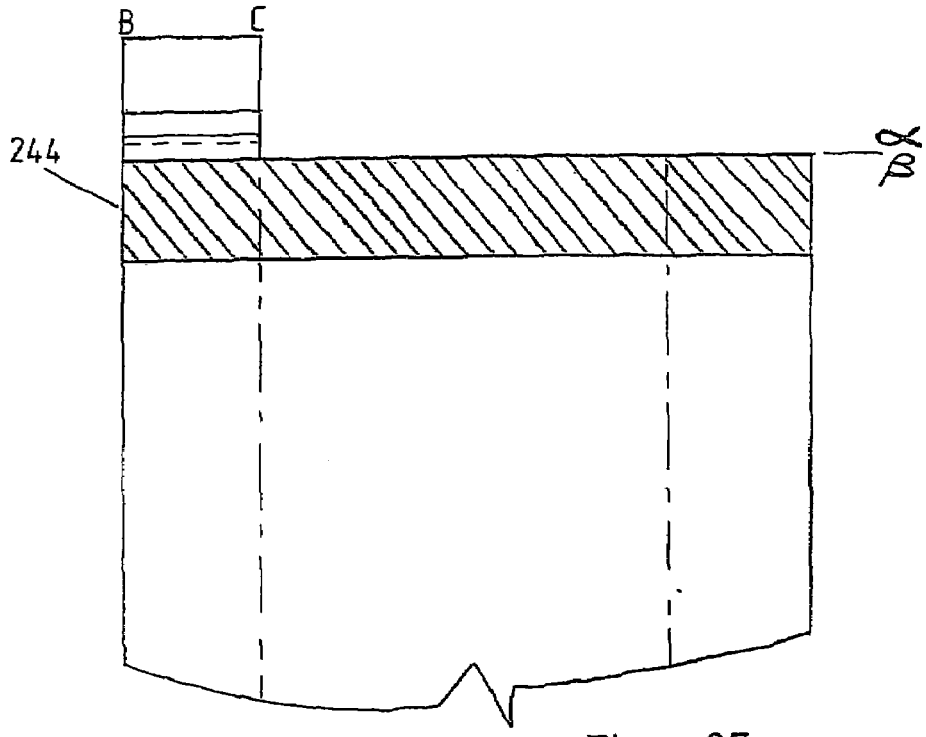
Figure 38:
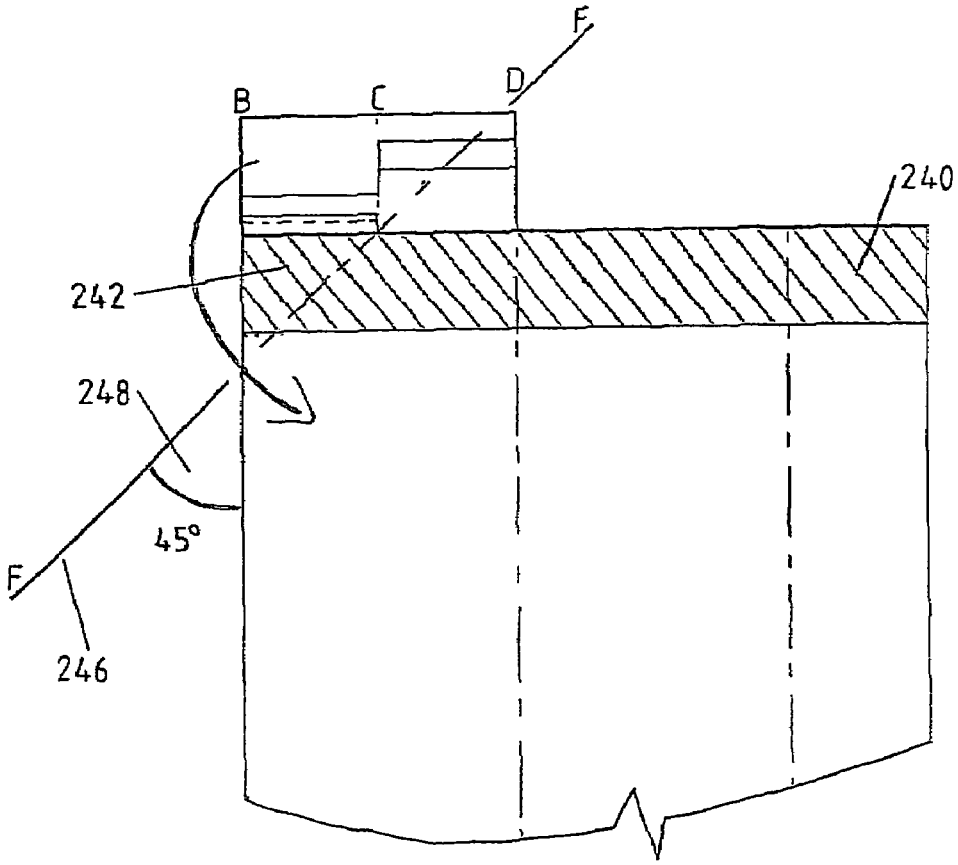
Figure 39:
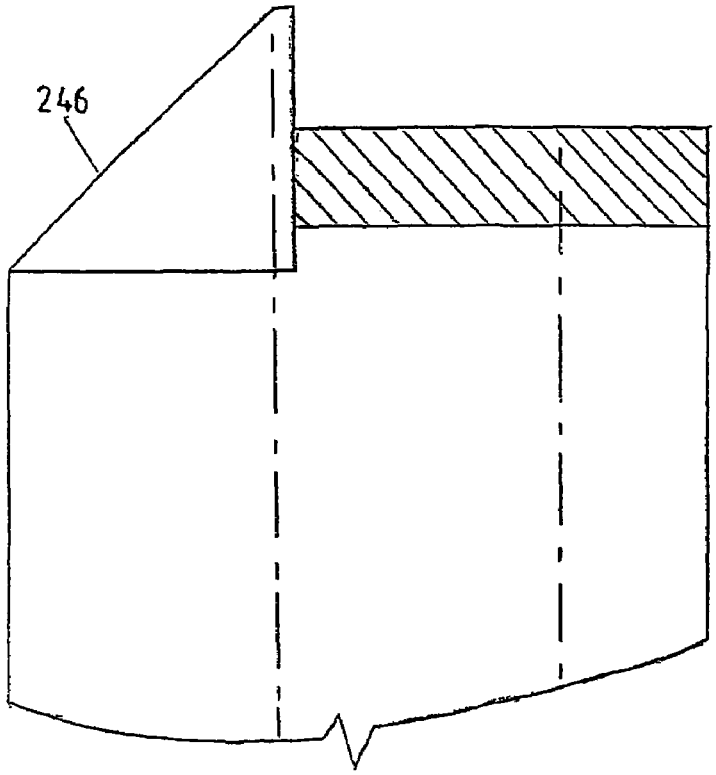
Figure 40:
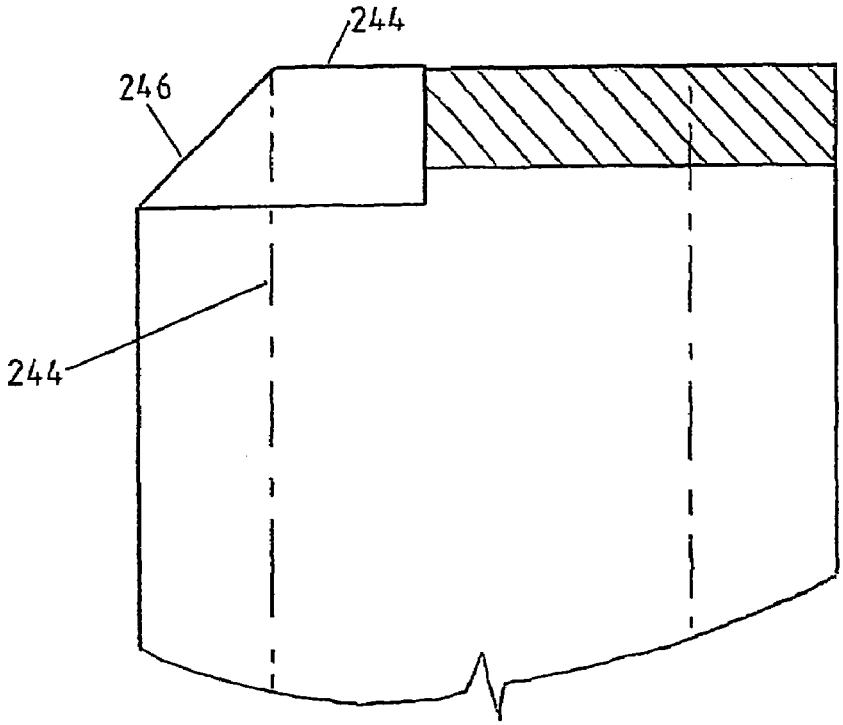

FIGS. 37 to 40 illustrate key steps in container manufacture comprising the formation of the openable section adapted for non-destructive opening and reclosure. The process is analogous to that outlined in FIGS. 15 to 18 in reference to the second preferred embodiment of the invention. FIG. 37 illustrates the formation of folding means comprising a longitudinally extending fold line 244 formed in the container side edge. FIG. 38 illustrates the subsequent formation of folding means comprising a fold line 246 formed in the openable section of the container by folding through line 246. FIG. 39 shows the openable section folded along line 246. To complete the formation of the folding means and closure of the openable section, the container side edge (blocked from view) is refolded along formed fold line 244 (comprising the gusset) causing the openable section to engage the container top end. The preferred angle (shown at 248) of formation of fold line 246 is around 45 degrees from the vertical for a tight closure.

Figure 41:
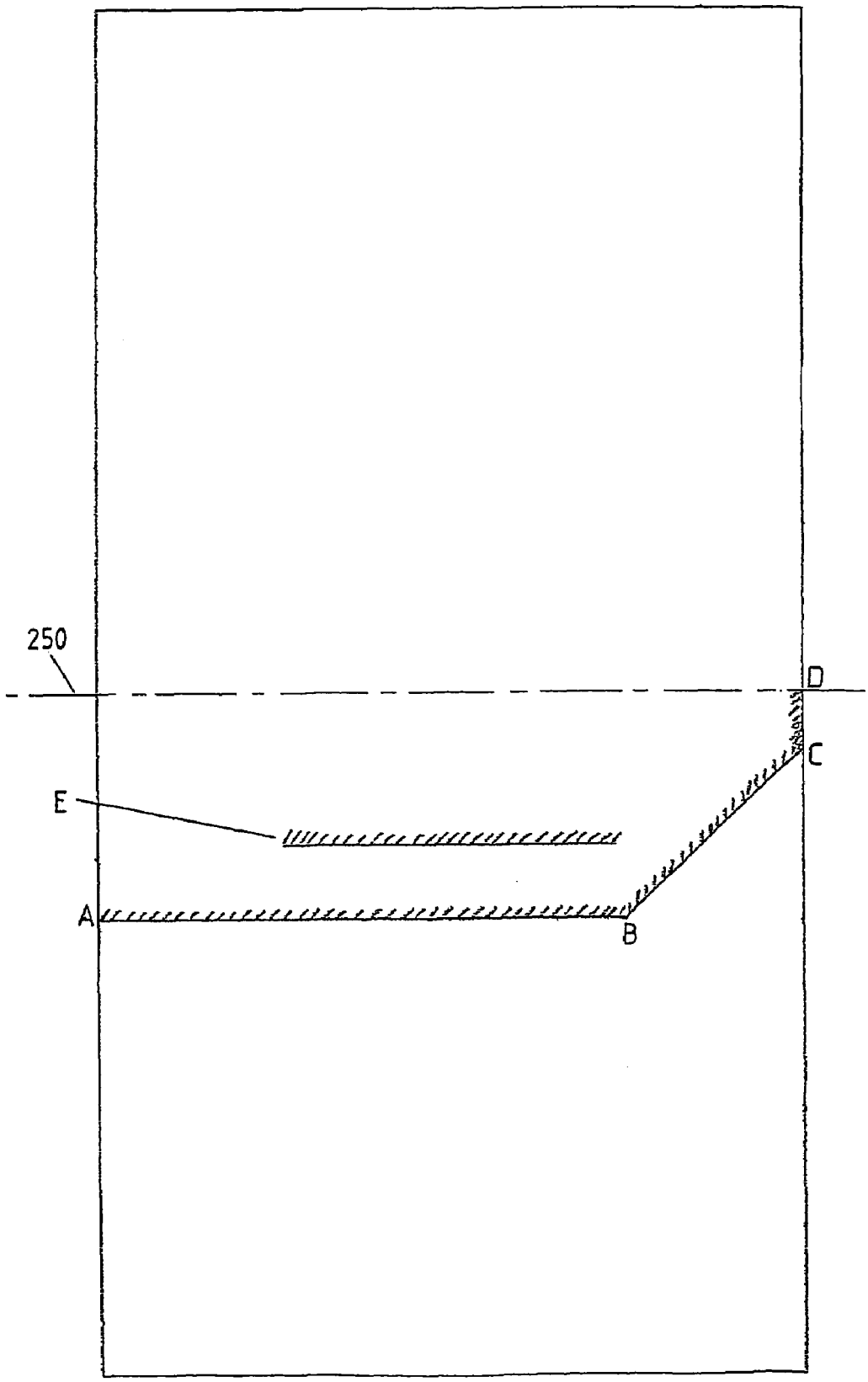
FIGS. 41 to 42 illustrate support means according to a preferred embodiment of the present invention.
Figure 42:
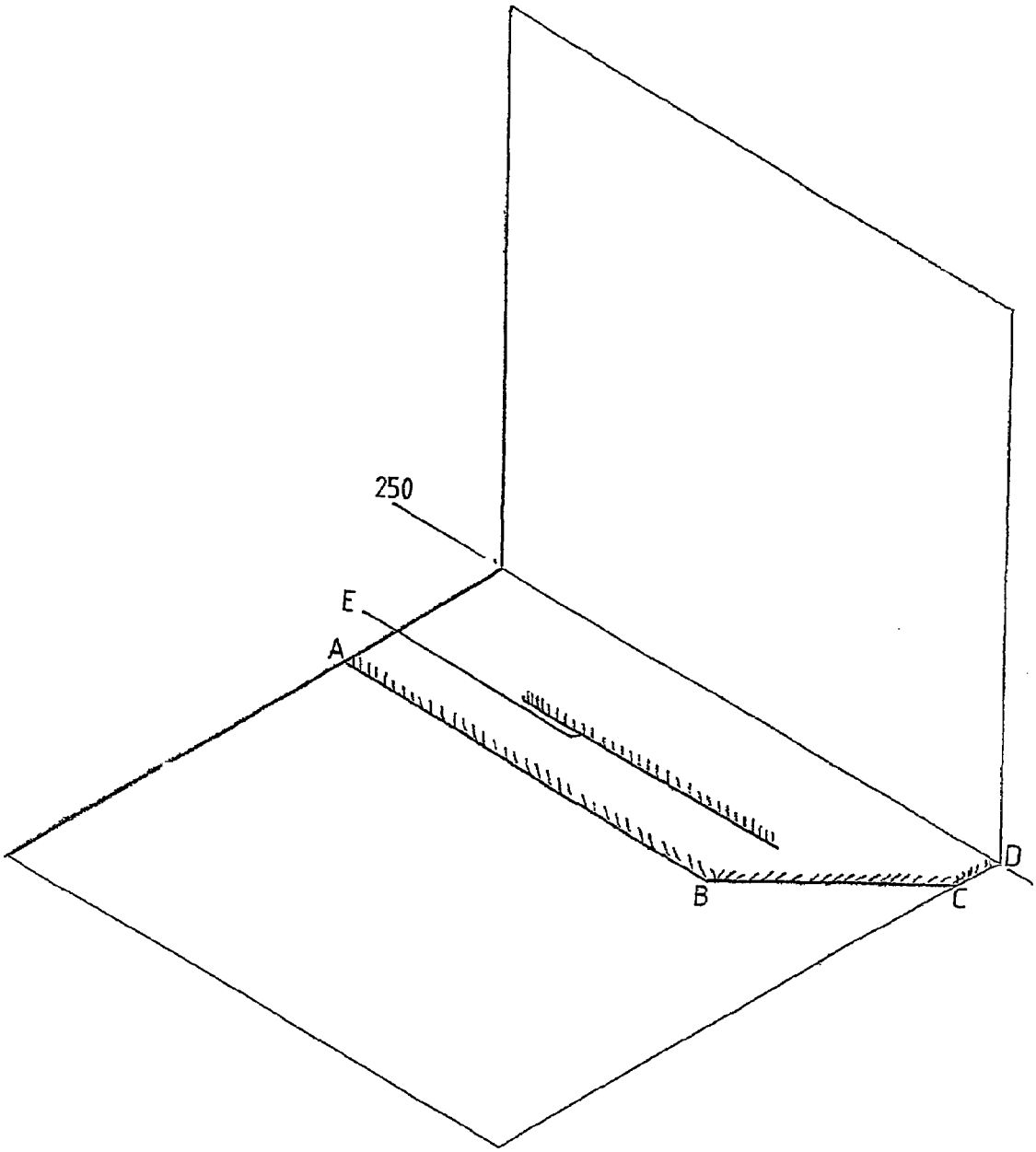

Referring now to FIGS. 41 to 42 there is illustrated a support means in accordance with a further preferred embodiment of the invention for use in the container. The preferred insert comprises a plie of paper glued and folded medially at 250 as opposed to the alternative form of insert (illustrated in FIG. 32) comprising two continuous plies of paper glued together. The insert is suitably of rectangular shape and sized for alignment within the closed section of the container preferably intermediate the gusset side edges. During the lamination process the insert is glued together in the closed section area along line A-B-C-D and suitably E or alternatively throughout the area enclosed by line A-B-C-D. Importantly, glued edge C-D of the insert is to be positioned as close as possible to the discharge means side gusset. Further, the angle of glue line B-C will open or restrict the flow of contents through the discharge means as it is increased or decreased respectively. The plie is inserted into the container in a similar manner as illustrated in FIG. 22.

Whilst the above has been given by way of illustrative example of the present invention many variations and modifications thereto will be apparent to those skilled in the art without departing from the broad ambit and scope of the invention as herein set forth.

For example the container can be embodied in various forms as determined particularly by end-user requirements and factors including frequency of container use, cost, suitability for contents, health and safety regulations, filling capacity, discharge rate, re-closure potential and handling characteristics.

It would also be understood that the different embodiments of the invention illustrated are suited to different end uses and due to their distinct designs differ somewhat with respect to application, strength, durability, ergonomic and health and safety features, cost, closure and re-usability.

The invention claimed is:

1. A reclosable container having:

a body for holding contents;

said body having opposite ends between which extends a vertical axis, at least one of said ends being an openable end including integrally formed sectional closure means;

said sectional closure means including an openable section, a transversely adjacent closed section and a juncture intermediate said openable and closed sections at which said openable section terminates and said closed section begins;

said openable section having folding means including one or more fold lines along which said openable section is adapted to fold to close or unfold to open;

said openable section being reversibly foldable along said fold lines between an opened position and a closed position;

said opened position forming a pouring spout vertically extended relative to said juncture for discharge of container contents by unfolding said openable section from said closed position;

said closed position effecting container closure by folding retraction of said openable section to the closed position from said opened position along said one or more fold lines, said fold lines including fold lines extending from a region adjacent said juncture across the openable section to a side edge of the container and being obliquely oriented at an acute angle from an axis transverse to said vertical axis, the openable end being initially closed by closing the openable section along said fold lines to an initially closed position; and wherein said body includes front and back wall members, said front and back wall members being connected along front and back wall member side edges of the container by opposed side wall members, each of said side wall members including a vertically extending medial fold line forming an inwardly projecting side wall gusset, wherein said folding means having fold lines including a fold line on each of said front and back wall members, the respective fold lines on the front and back wall members intersecting one of said medial fold lines adjacent said openable section wherein folding said openable section from said opened position down along at least one of said front or back wall member fold lines and concomitant folding of said medial fold line inwardly effects container closure with a first upper portion of the side wall member being folded onto the front wall member and a second upper portion of the side wall member being folded onto the back wall member forming first and second oblique folds, the first oblique fold extending from adjacent the juncture forward of the vertically extending medial fold line to a side edge of the container and the second oblique fold extending from adjacent the juncture backward of the vertically extending medial fold line to the side edge of the container so that the first and second oblique folds are physically separate folds.

2. The container according to claim 1, wherein said front and back wall members are comprised of multiple layers.

3. The container according to claim 1, said openable section being securable in said closed position to one of said front or back wall members.

4. The container according to claim 1, said closed section further including a reinforced handle vertically inferior to said openable end.

5. The container according to claim 1, said closed section further including a handle vertically inferior to said openable end, wherein said handle includes support means comprising a reinforcement to said handle, said reinforcement comprising an insert surrounding said handle.

6. The container according to claim 1, wherein each of said inwardly projecting side wall gussets is secured on opposed sides of said medial fold line adjacent said openable end of the container, wherein said side wall gusset adjacent said openable section is releasably secured.

7. The container according to claim 1, wherein said container openable end is formed by a shape cut defining a plurality of vertically spaced straight edge sections along said openable end.

8. The container according to claim 1, wherein said back wall member is vertically extended relative to said front wall member in said openable end to form an overhanging portion adapted to fold down as a flap overlapping said front wall member, the overhanging portion including a notch, said notch extending transversely between said side edge and said juncture wherein said overhanging portion of said back wall member is secured to said front wall member at at least the closed section of said openable end.

9. A reclosable container according to claim 1 wherein the container openable section is sealed prior to the container being filled.

10. A reclosable container according to claim 1 wherein the container openable section is sealed prior to the container being filled from the end opposite the openable end.

11. A reclosable container according to claim 1 wherein the openable end is closed and the end opposite the openable end is an open end for filling purposes.

* * * * *